US005718467A

United States Patent [19]

Weinerman et al.

[11] Patent Number: 5,718,467

[45] Date of Patent: *Feb. 17, 1998

[54] RACKING RESISTANT DOOR CONTROL MECHANISM

[75] Inventors: Lee S. Weinerman, Medina; James L. Hollingsworth, Middleburg Heights; Fredrick L. Putzier, Columbia Station, all of Ohio

[73] Assignee: The Eastern Company, Cleveland, Ohio

[ * ] Notice: The term of this patent shall not extend beyond the expiration date of Pat. No. 5,718,466.

[21] Appl. No.: 643,004

[22] Filed: May 3, 1996

Related U.S. Application Data

[63] Continuation-in-part of Ser. No. 556,607, Nov. 13, 1995, and Ser. No. 556,608, Nov. 13, 1995, abandoned.

[51] Int. Cl.[6] ..... E05C 3/14

[52] U.S. Cl. ..... 292/218; 292/241; 292/DIG. 32

[58] Field of Search ..... 292/218, 241, 292/DIG. 32, DIG. 72; 384/434, 442, 428, 283, 432, 909, 624; 411/171

[56] References Cited

U.S. PATENT DOCUMENTS

| | | | |
|---|---|---|---|
| D. 228,169 | 8/1973 | Morris | D8/137 |
| D. 228,170 | 8/1973 | Morris | D8/137 |
| D. 242,428 | 11/1976 | Morris | D8/137 |

(List continued on next page.)

FOREIGN PATENT DOCUMENTS

| | | | |
|---|---|---|---|
| 236831 | 9/1987 | European Pat. Off. | 384/429 |
| 35390 | 8/1913 | Sweden | 292/218 |

OTHER PUBLICATIONS

Eberhard Manufacturing Co., Division of the Eastern Company, "Eberhard Industrial & Vehicular Hardware" Catalog #106, Jan. 1994, pp. 120–140, Cleveland, OH 44136.

ZRC Products Co, "The 13 Questions Most Asked About ZRC", 4 page Brochure, (date unknown, but believed to be prior to Nov. of 1995), Quincy, MA 02170.

ZRC Products Co, "Corrosion Control—Cold Galvanizing Compound," 4 page brochure, (date unknown, but believed to be 1992), Quincy, MA 02170.

ZRC Products Co, "Your Future is Bright, With Galvilite," 2 page Brochure, (Date Unknown, but believed to be prior to Nov. 1995), Quincy, MA 02170.

E.I. DuPont de Nemours & Co., "Design Handbook for DuPont Engineering Plastics . . . Delrin"—p. 5—(Date Unknown, but believed to be prior to Nov. of 1995, Wilmington, DE 19898.

*Primary Examiner*—Rodney M. Lindsey
*Attorney, Agent, or Firm*—David A. Burge

[57] ABSTRACT

A racking resistant door control mechanism for securing a pivoted door employs an elongate lock rod that extends the height of the door, is journaled for pivotal movement about a lock rod axis by door mounted bearing assemblies, and has cam type latch members welded to its opposite ends for engaging keeper members carried by upper and lower parts of a door frame. The cam and keeper members feature novel, compact arrangements of interengageable formations that are located on opposite sides of, but relatively near to, the lock rod axis of the locked door—formations that cooperate in bringing the door to its fully closed position, in securely retaining the door closed, in preventing racking movements of the closed door and its adjacent door frame, and in breaking the door open when ice formations, cold seals or the like resist initial opening movement of the door. Additional racking resistance preferably is provided by utilizing upper and lower end regions of door mounted bearing assembly covers to engage shoulders defined at junctures of the cam members with opposite ends of the lock rod, and to engage opposite end portions of at least one other lock-rod-carried component so that a plurality of lock-rod-carried components are engaged by door mounted components in a manner that is highly effective in resisting relative axial movements of the locked door, the door frame and other lock-rod-connected components.

50 Claims, 10 Drawing Sheets

U.S. PATENT DOCUMENTS

| | | | |
|---|---|---|---|
| D. 247,546 | 3/1978 | Shaw et al. | D8/344 |
| D. 247,871 | 5/1978 | Shaw et al. | D8/343 |
| D. 249,634 | 9/1978 | Pastva | D8/346 |
| D. 250,247 | 11/1978 | Pastva | D8/339 |
| D. 294,452 | 3/1988 | Bakula | D8/330 |
| D. 351,987 | 11/1994 | Lee | D8/343 |
| D. 353,318 | 12/1994 | Lee | D8/343 |
| 1,113,209 | 10/1914 | Flaherty et al. | 384/434 |
| 1,952,112 | 3/1934 | Bartsch | 292/218 |
| 1,988,585 | 1/1935 | Dath | 20/21 |
| 2,268,520 | 12/1941 | Wesley | 411/171 X |
| 2,278,301 | 3/1942 | Bauer | 411/171 X |
| 2,301,444 | 11/1942 | Olander | 292/218 |
| 2,442,031 | 5/1948 | Beauchamp | 20/23 |
| 2,451,537 | 10/1948 | Dath | 292/218 |
| 2,505,945 | 5/1950 | Dath . | |
| 2,538,203 | 1/1951 | Lehman | 292/218 |
| 2,764,443 | 9/1956 | Bennett | 292/240 |
| 2,765,189 | 10/1956 | Forssell | 292/340 |
| 2,859,790 | 11/1958 | Sitrin | 411/171 |
| 2,861,830 | 11/1958 | Bennett | 292/240 |
| 3,099,473 | 7/1963 | Pastva | 292/240 |
| 3,134,618 | 5/1964 | Heimann | 292/240 |
| 3,160,433 | 12/1964 | Chieger et al. | 292/241 |
| 3,188,128 | 6/1965 | Olander | 292/240 |
| 3,212,805 | 10/1965 | Olander | 292/218 |
| 3,281,177 | 10/1966 | Tenenbaum | 292/241 |
| 3,378,294 | 4/1968 | Olander | 292/218 |
| 3,451,705 | 6/1969 | Turpen | 292/218 |
| 3,464,729 | 9/1969 | Chambers | 292/218 |
| 3,484,127 | 12/1969 | Pastva | 292/218 |
| 3,544,145 | 12/1970 | Cerutti | 292/54 |
| 3,572,794 | 3/1971 | Pastva | 292/218 |
| 3,596,403 | 8/1971 | Carr | 49/256 |
| 3,661,412 | 5/1972 | Morris | 292/213 |
| 3,664,695 | 5/1972 | Sickel | 292/54 |
| 3,695,661 | 10/1972 | Pastva | 292/218 |
| 3,737,183 | 6/1973 | Pastva | 292/7 |
| 3,756,671 | 9/1973 | White | 308/15 |
| 3,784,243 | 1/1974 | Pastva | 292/300 |
| 3,790,355 | 2/1974 | Palisin, Jr. | 29/195 |
| 3,801,146 | 4/1974 | Donath et al. | 292/218 |
| 3,891,112 | 6/1975 | Lycett et al. | 292/218 |
| 3,893,734 | 7/1975 | Ulbrich . | |
| 3,912,312 | 10/1975 | Cerutti | 292/218 |
| 3,927,816 | 12/1975 | Nakamura | 228/147 |
| 4,014,138 | 3/1977 | White | 49/367 |
| 4,029,349 | 6/1977 | Sweda et al. | 292/241 |
| 4,068,409 | 1/1978 | White | 49/367 |
| 4,087,122 | 5/1978 | Shaw et al. | 292/218 |
| 4,127,291 | 11/1978 | Pelcin | 292/54 |
| 4,146,257 | 3/1979 | Pastva | 292/218 |
| 4,235,463 | 11/1980 | Benevenuta | 292/218 |
| 4,483,557 | 11/1984 | Pastva | 292/218 |
| 4,601,501 | 7/1986 | Pastva | 292/218 |
| 4,690,442 | 9/1987 | Reynard | 292/218 |
| 4,753,466 | 6/1988 | Umebachi et al. | 292/218 |
| 4,768,816 | 9/1988 | Bakula | 292/218 |
| 4,843,857 | 7/1989 | Krieps | 72/58 |
| 4,844,523 | 7/1989 | Pastva | 292/218 |
| 4,844,524 | 7/1989 | Pastva | 292/218 |
| 5,016,393 | 5/1991 | Weinerman | 49/395 |
| 5,046,770 | 9/1991 | Hansen | 292/218 |

RACKING RESISTANT DOOR CONTROL MECHANISM

CROSS-REFERENCE TO RELATED APPLICATIONS

The present application is a continuation-in-part of two applications filed Nov. 13, 1995 by Lee S. Weinerman et al, namely application Ser. No. 08/556,607 entitled RACKING RESISTANT DOOR CONTROL MECHANISM AND METHOD OF FABRICATION (Atty's Docket No. 5-210—referred to hereinafter as the First Parent Case), and application Ser. No. 08/556,608 now abandoned entitled CORROSION RESISTANT DOOR CONTROL MECHANISM AND METHOD OF FABRICATION (Atty's Docket No. 5-120—referred to hereinafter as the Second Parent Case). The disclosures of these Parent Cases are incorporated herein by reference.

BACKGROUND OF THE INVENTION

1. Field of the Invention

The present invention relates to cam and keeper members for use in a racking resistant door control mechanism for securing pivoted doors of trucks, trailers, large cargo containers and the like, wherein the door control mechanism employs an elongate lock rod for extending the height of a pivoted door, with the cam members being connected to its upper and lower ends for being rotated about a pivot axis of the lock rod for engaging the keeper members which are connected to upper and lower parts of a door frame for securing the door closed. More particularly, the present invention relates to cam and keeper members that feature a novel, compact arrangement of interengageable formations that are grouped advantageously to extend closely about the pivot axis of a door mounted lock rod to cooperate in bringing the door to its fully closed position, in retaining the door closed, in preventing racking movements of the closed door and its adjacent door frame, and in breaking the door open, with additional racking resistance preferably being provided by utilizing door mounted bearing covers to engage shoulders defined at junctures of the cam members with opposite ends of the lock rod, and to engage opposite end portions of at least one other lock-rod-carried component so that a plurality of lock-rod-carried components are engaged by door mounted components in a manner that is highly effective in resisting relative axial movements of the locked door, the door frame and other lock-rod-connected components.

2. Prior Art

Load carrying compartments of trucks, trailer bodies and transport cargo containers typically use relative large single or paired sets of pivoted doors to provide access for loading and unloading. Because the door openings are large and often are defined at compartment ends by door frames that are not easily cross-braced and may be subject to distortion known as "racking," each of the pivoted doors typically is secured by a door control mechanism having a lock rod which extends the full height of the door, with the lock rod being rigidly connected at its opposite ends to cam type latch members configured to engage keeper members carried by top and bottom portions of the door frame, with mounting and operating components of the door control mechanism being carried by the door, and with various ones of these door mounted components being configured to cooperate with lock-rod-carried components in securing the door and in resisting racking movements of the closed door and its surrounding door frame.

Over the years, cam and keeper proposals have been influenced by a variety of considerations. For example, to avoid having to provide differently configured cams and keepers for use at opposite ends of a lock rod (i.e., cams and keepers that are mirror images of each other), some proposals emphasize the importance of symmetrically configured cam and keeper designs that are "reversible" so that identical cams and identical keepers may be used at upper and lower ends of a lock rod.

In seeking performance improvements, cam and keeper design proposals have addressed such objectives as providing enhanced racking resistance and an enhanced capability to resist the heavy loads that may be imposed on pivoted doors by shifting or shifted cargo. Cams have been proposed having opposed arms that each define a generally V-shaped notch configured to receive and cooperate with a separate, suitably configured, wedge-shaped keeper formation—an arrangement that has been exploited by some designs not only to provide strong, breakage resistant components and enhanced racking resistance, but also to provide cam and keeper components that will advantageously interact during latching so as to bring misaligned door and door frame portions into proper alignment.

In order for interengaged cam and keeper formations to maintain their proper engagement to hold a door closed and to resist racking of the closed door and its door frame, abutment surfaces typically are provided on the cam and on the keeper—surfaces 1) that are brought into abutting engagement as a lock rod pivots the cam to engage the keeper to bring the pivoted door to its fully closed and latched position, and 2) that are intended to remain in engagement during the entire time that the door is closed and latched to aid in transferring door loading forces from the cams to the keepers. If such loadings as are imposed on the closed and latched door (e.g., due to forces generated by shifting cargo, or forces tending to distort the door and its door frame as a truck moves over uneven terrain, or the like) succeed in moving the abutment surfaces out of engagement, this "loosening" of the engagement between the cam and keeper members may defeat the capabilities of the door control mechanism to resist racking, to resist being damaged during use, and to maintain door closure so that cargo loss does not occur.

Reasons that often aid in explaining why prior cam and keeper proposals have failed to maintain proper abutment surface engagement have to do with poor location, poor orientation, and poor configuration of such abutment surface portions as actually engage when a cam and keeper are fully latched. The location of engaging abutment surface portions (that engage to transmit door loading forces and the like between cam and keeper members when a pivoted cargo door is fully closed and latched) at a significant distance from the pivot axis of the locking rod can result in significant torque loadings being imposed on the locking rod that may tend to pivot the lock rod in an "unlatching" direction of movement. The closer that the engaging portions of the abutment surfaces can be located to the pivot axis of the locking rod, the less unlatching torque that will be generated by the same magnitude of door loading force, and the less likely will be the failure of the door control mechanism due to unlatching rotation of the locking rod.

The orientation of the abutment surface portions that actually engage also is important, for inappropriate orientation of the plane of engagement can cause "normal" and "tangential" components of the force that is being transmitted from a cam to a keeper to interact in such a way as to cause unlatching rotation or other undesired movement of the locking rod that may, in turn, cause the cam to release its latching engagement with the keeper. Many prior proposals have neglected to take properly into account the important role that abutment surface location and orientation can play in determining how a particular cam and keeper configuration will perform.

Still another aspect of cam and keeper engagement that needs to be taken properly into account is the configuration of such abutting surface portions as actually engage when the cam and keeper are latched. Previous proposals typically have called for the abutment surface portions that actually engage to be defined by different radii of curvature—an arrangement that has severely limited the size of the surface area wherein the cam and keeper abutment surfaces actually engage. By minimizing the size of the surface area wherein the abutment surfaces actually engage, the magnitude of the force that must be transmitted per unit of surface area is caused to be quite high—often calling for many thousands of pounds of force to be transmitted between engaging cam and keeper surface areas that measure considerably less than a square inch in size. These force-concentrated loadings imposed on cam and keeper members can cause structural failures that are far less likely to occur if the same loadings are distributed across engagement surface areas of greater size.

A significant drawback common to many previously proposed cam and keeper configurations is their overall size. As doors have increased in size while door frames have diminished in size (to meet present day needs that call for access openings of maximum size to be provided in cargo carrying compartments that are of strictly limited exterior dimension), it has become increasingly important for cam and keeper components to exhibit narrow profiles and to occupy only a minimum of space—and to do these things without unduly limiting their capability to perform latching and closure retaining functions, and to exhibit good racking resistance in the presence of severe door loadings. Many previously proposed cam and keeper configurations do not offer the combination of maximized performance and minimized size that is required to meet present day needs.

A need not specifically addressed by many cam and keeper proposals is the provision of cam and keeper surfaces that are intended to engage during unlatching to break open a closed door that initially may tend to resist opening due to a buildup of ice around door and door frame junctures, due to seals that have become relatively rigid in a cold environment, due to a difference in air pressure on opposite sides of the door, etc.—which tendency frequently is encountered with the tightly fitting, seal carrying doors of refrigerated trucks and the like. In efforts to provide cam and keeper configurations that are of narrow profile and small size, and that offer a high degree of racking resistance as well as an ability to maintain door closure in the presence of severe door loadings, the desirability of also incorporating into cam and keeper designs an interaction capability to break open stubborn doors often has fallen by the wayside.

3. The Referenced "First and Second Parent Cases"

The referenced First Parent Case addresses the need to provide enhanced racking resistance in a door control mechanism by utilizing door mounted components and lock-rod-carried components that feature an advantageous series of engagements. All but two of the engaging door mounted and lock-rod-carried components are arranged "in series engagement" so that a maximum number of racking resistant engagements are defined by a minimum number of components. In preferred practice, the present invention utilizes the "in series engagement" arrangement of door control mechanism components that forms the subject of the First Parent Case, the disclosure of which is incorporated herein by reference.

The referenced Second Parent Case addresses the need to provide ferrous metal components of a door control mechanism with good corrosion resistance—it being noted that the normal operating environment in which cargo containers, freight hauling trucks and the like are employed may frequently expose door control mechanism components to inclement weather as well as salt spray and other conditions or substances that tend to promote corrosion. In preferred practice, the present invention utilizes cams, keepers and other door control mechanism components that have had their exposed surfaces protected utilizing features of the proposal that forms the subject of the Second Parent Case, the disclosure of which is incorporated herein by reference.

SUMMARY OF THE INVENTION

The present invention addresses the foregoing and other needs, considerations and drawbacks of the prior art by providing cam and keeper members of novel and improved configuration that utilize a compact arrangement of interengageable formations to provide a racking resistant door control mechanism for securing a pivoted door of a cargo vehicle or container having an elongate lock rod that extends the height of the door, that is journaled for pivotal movement about a lock rod axis by door mounted bearing assemblies, and that deploys the cam type latch members by connecting them to opposite ends of the lock rod for latchingly engaging the keeper members which are connected to upper and lower parts of a door frame.

One feature of cams and keepers that embody the preferred practice of the present invention resides in their being of relatively small size and presenting a relatively narrow profile to comply with present day requirements without sacrificing the important capabilities of these members, when fully latched, to transmit relatively high force loadings therebetween, to resist racking, and to exhibit desirably lengthy service lives.

Another feature of preferred practice resides in the employment of cam and keeper abutment surfaces that are located, oriented and configured in a manner that tends not to unlatch, pull apart, deform or break—an arrangement that has been proved in tests of high loading forces applied to cargo doors to remain latched and to remain serviceable when many other cam and keeper configurations employed in present-day service have been found to fail. Engaged abutment surfaces are located in unusually close proximity to the locking rod pivot axis, are oriented to extend nearly parallel to the plane of the door they hold closed, and are configured to provide relatively large, relatively flat surface areas of engagement to avoid the generation of stress concentrations.

In preferred practice, an enlarged head formation that defines the keeper's abutment surface has an end portion that extends unusually close to the pivot axis of the cam—to a location that overlies a space in which a central portion of the cam resides when the cam and keeper are fully latchingly engaged. To accommodate the end portion of the keeper (the presence of which otherwise would interfere with movement of the cam into and out of engagement with the keeper), a U-shaped recess is formed in the cam to receive and to "wrap about" the keeper end portion during latching and unlatching movements of the cam and the keeper.

In preferred practice, a cam and keeper are provided with interfitting formations that cooperate in bringing the door to its fully closed position, in securely retaining the door closed even when the door is subjected to relatively high cargo imposed loadings, in preventing racking movements of the closed door and its adjacent door frame, and in breaking the door open when ice formations, cold seals or the like resist initial opening movement of the door. Two opposed cam arms that carry V-shaped notches engage separate, spaced keeper posts of wedge-shaped cross-section to axially align the cams and keepers during latching, and to oppose racking forces when latched. Recognition is taken of the fact that, as the two arms of the cam rotate into and out of engagement with the keeper, only one of the arms carries out 1) the bulk of the alignment effort, 2) the bulk of the door closing effort, and 3) the bulk of the door opening effort. This "primary" arm is given greater length than the "secondary" arm, is provided with a V-shaped notch that is of greater length that is the notch formed in the "secondary" arm, and is provided with a more gentle notch taper than is used with the notch of the "secondary" arm; and corresponding improvements are made in such portions of the keeper as interact with the "primary" arm—the result being to provide a smooth acting, easy to operate door control mechanism that puts to good use the limited space occupied by its components.

In providing anti-racking capabilities, two undesirable types of relative movement (in a direction extending axially along the lock rod of a door control mechanism) are to be inhibited and held to a minimum. Providing improved double-wedge-acting cams and keepers that tend to maintain fully latched engagement (i.e., cams and keepers that incorporate the improvements disclosed herein) deals with one of these undesired types of movement, namely movement that may tend to occur between a locking rod and keeper-carrying upper and lower portions of a door frame. Providing lock-rod-carried and door connected components that engage in advantageous ways (in accordance with features of the invention of the First Parent Case) deals with the other of these undesired types of movement, namely movement that may tend to occur between a locking rod and the door portions on which it is pivotally mounted. In most preferred practice, the present invention utilizes its improved cam and keeper features in combination with the improvements of the First Parent Case to provide a door control mechanism that offers the fullest possible scope of racking resistance.

More particularly, the cams and keepers of the present invention preferably are used with door control mechanism components that are arranged in the manner that is described in the referenced First Parent Case to provide enhanced racking resistance by positioning upper and lower end regions of door mounted bearing assembly covers 1) to engage shoulders defined at junctures of the cam members with opposite ends of the lock rod, and 2) to engage opposite end portions of at least one other lock-rod-carried component so that a plurality of lock-rod-carried components are engaged by door mounted components in a manner that is highly effective in resisting relative axial movements of the locked door, the door frame and the components of the door control system.

In preferred practice, a racking resistant door control mechanism employs an elongate lock rod that extends the height of a door on which the lock rod is mounted, with the lock rod being journaled for pivotal movement about a pivot axis that extends centrally along the length of the lock rod by bearing assemblies having steel covers that are connected by fasteners to the door. The lock rod has upper and lower cam type latch members (that embody improvement features of the type described above) connected to its opposite ends for engaging keeper members carried by upper and lower parts of a door frame for holding the door closed. The lock rod also extends through and is welded to a steel sleeve at a location spaced a short distance upwardly from the location of the lower latch member. The steel sleeve and the steel bearing covers are configured and positioned such that the steel bearing covers are held in engagement 1) with the cam type latch members, and 2) with opposite ends of the sleeve, to thereby provide a high degree of resistance to axial movement of the lock rod relative to the door on which it is mounted.

In preferred practice, the steel sleeve has a bottom surface that faces downwardly toward an upwardly facing surface of the bottom cam member, and a bottom bearing cover has a height that is received in a slip fit so as to be closely sandwiched between these downwardly and upwardly facing surfaces—a construction that, in and of itself, serves to prevent axial movement of the lock rod relative to the door to which the bottom bearing cover is bolted.

In preferred practice, the steel sleeve has upwardly and downwardly facing surfaces at its opposite ends, and is sandwiched in a slip fit between the relatively large bottom bearing cover and a relatively smaller strap-like bearing cover that is bolted to the door just atop the sleeve—a construction that also, in and of itself, serves to prevent axial movement of the lock rod relative to the door to which the bottom bearing cover is bolted.

In preferred practice, the two construction arrangements just described, each of which serves independently to block both upward and downward axial movements of the lock rod relative to the door on which it is mounted, are used in combination with still another construction that also serves to prevent axial movement of the lock rod. This third construction utilizes engagement between a bottom surface of the bottom bearing cover and an upwardly facing surface of the bottom cam member (which blocks upward movement of the lock rod relative to the door), and between a top surface of the top bearing cover and a downwardly facing surface of the upper latch member (which blocks downward movement of the lock rod relative to the door).

Also, in preferred practice, the advantageously configured cams and keepers of the present invention (and other components of the door control mechanism with which the cams and keepers are used) have their exposed ferrous metal surfaces provided with corrosion resistance in accordance with the approach that is described in the referenced Second Parent Case. The various metal components of the door control mechanism including the steel sleeve and the steel bearing covers are protectively coated before being welded or otherwise assembled. Some rigid connections between components of the lock rod assembly preferably are formed by utilizing normally hidden welds of relatively small size that burn through the protective coatings and are, in turn, protectively coated by a zinc rich, polymer containing film applied as a "touch-up" spray that matches the appearances of the corrosion resistant coatings applied to the various metal components.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
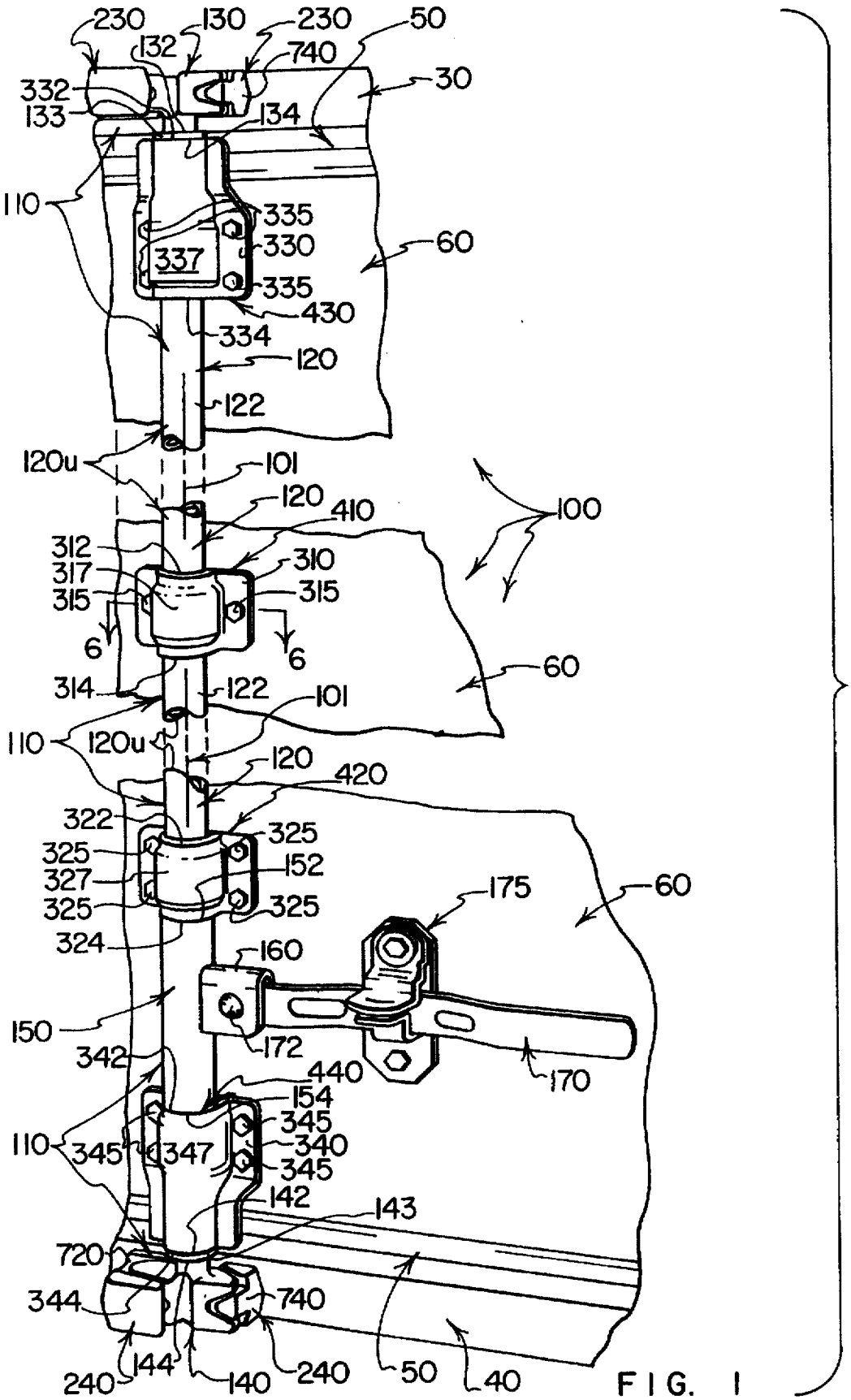
FIG. 1 is a foreshortened perspective view depicting principally front and right side portions of a door control mechanism connected to portions of a vehicle cargo door and an associated door frame, with the mechanism including a door mounted, vertically extending lock rod assembly provided at its upper and lower ends with cam type latch members, with the cam members engaging frame mounted keeper members to hold the door closed with respect to the frame.
Figure 2:
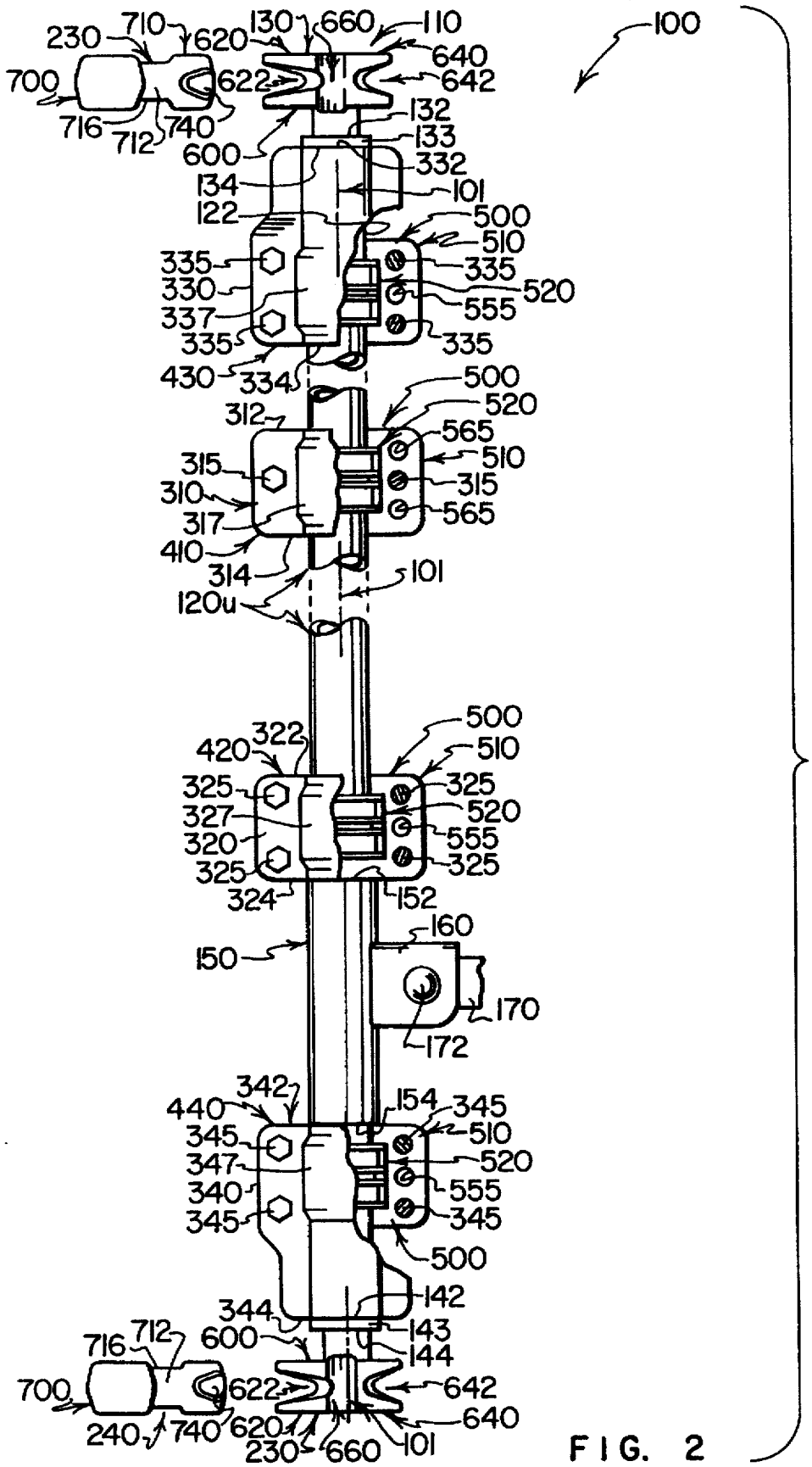
FIG. 2 is a foreshortened front elevational view of the lock rod assembly, with portions broken away to permit underlying features including the locations of four plastic bearing liner assemblies to be viewed.
Figure 3:
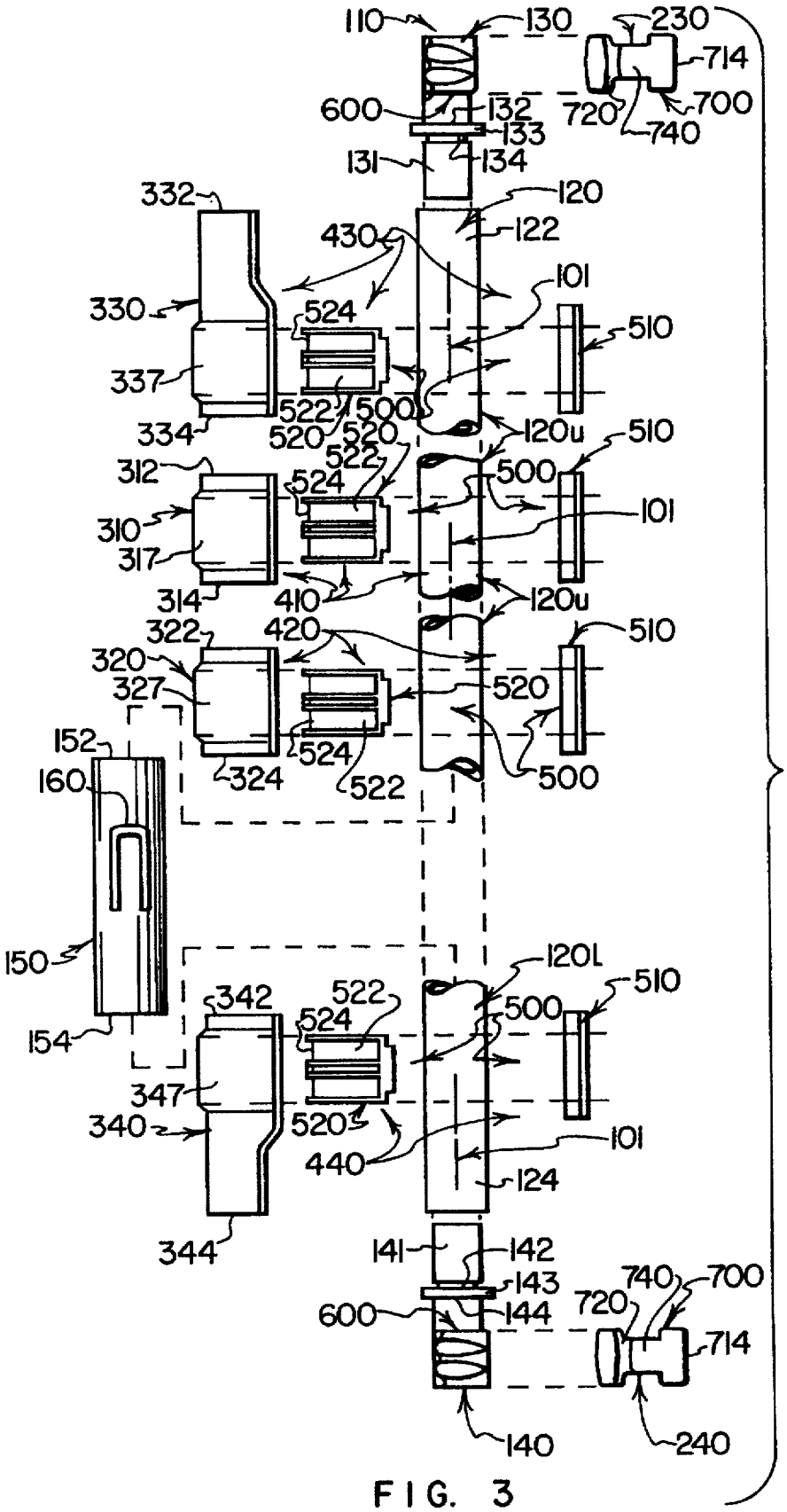
FIG. 3 is a foreshortened, exploded, right side elevational view showing selected components of the rod lock assembly.

Referring to FIGS. 1–3, a door control mechanism that embodies the preferred practice of the present invention is indicated generally by the numeral 100. Because a majority of the components of the door control mechanism 100 are identical to components of door control mechanisms that are described in the referenced Parent Cases, features that are shared by the door control mechanism 100 and the door control mechanisms of the Parent Cases will be described before turning to a detailed description of unique features of cam type latch members 130, 140 and keeper members, 230, 240—features that differentiate the door control mechanism 100 from the door control mechanisms that are described in the Parent Cases.

Shown in FIG. 1 are upper and lower frame portions of a load carrying compartment of a truck body; a trailer body, or a cargo container, which are designated by the numerals 30, 40, respectively. Defined between the upper and lower door frame portions 30, 40 is a door opening, indicated generally by the numeral 50. A door 60 is shown in closed position—wherein the door 60 closes at least a significant portion of, if not the entirety of, the door opening 50.

In a manner well understood by those who are skilled in the art, the door 60 is hinge-mounted for pivotal movement about a vertically extending axis (not shown) that is located a suitable distance to one side of the depicted door control mechanism 100 (i.e., rightwardly with respect to what is depicted in FIG. 1) so that the door 60 can pivot between an open position (not shown) and the fully closed and latched position that is depicted in FIG. 1.

Referring to FIGS. 1–3, the door control mechanism 100 includes a welded lock rod assembly that is indicated generally by the numeral 110. The assembly 110 includes an elongate tubular lock rod 120 that has upper and lower end regions 122, 124 (see FIG. 3). An upper cam type latch member 130 and a lower cam type latch member 140 (which have configurations that are mirror images of each other, as will be seen by comparing the more detailed depictions of these components provided by FIGS. 8 and 9, respectively) are connected to the upper and lower end regions 122, 124, respectively. A steel sleeve 150 (of slightly greater inner diameter than is the outer diameter of the tubular lock rod 120) is slip-fit onto the lock rod 120 and is welded in place at a location spaced a short distance upwardly from the lower latch member 140.

Figure 8:
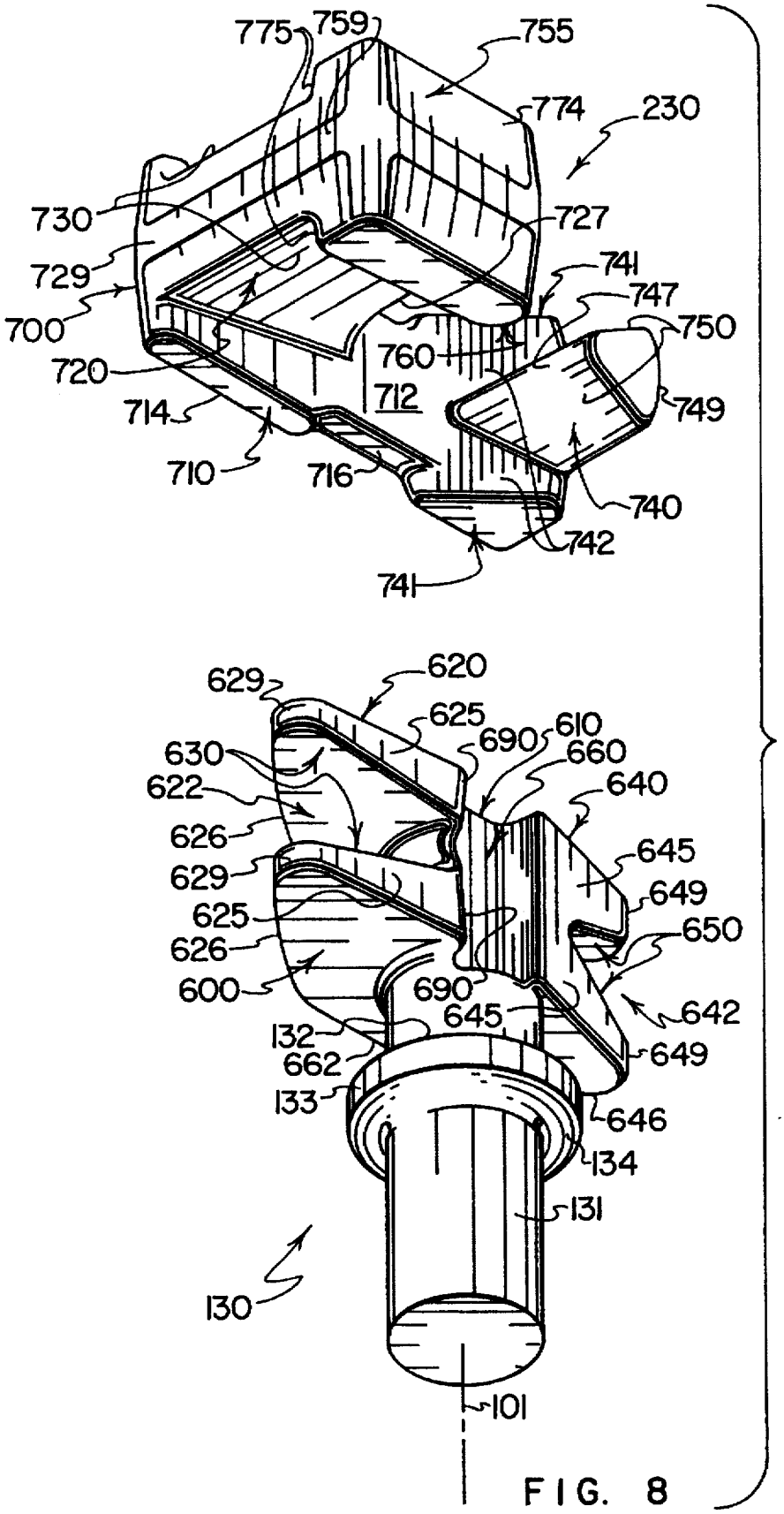
FIG. 8 is an exploded perspective view, on an enlarged scale that is utilized in all of the remaining views, showing the upper cam and keeper members of the rod lock assembly.
Figure 9:
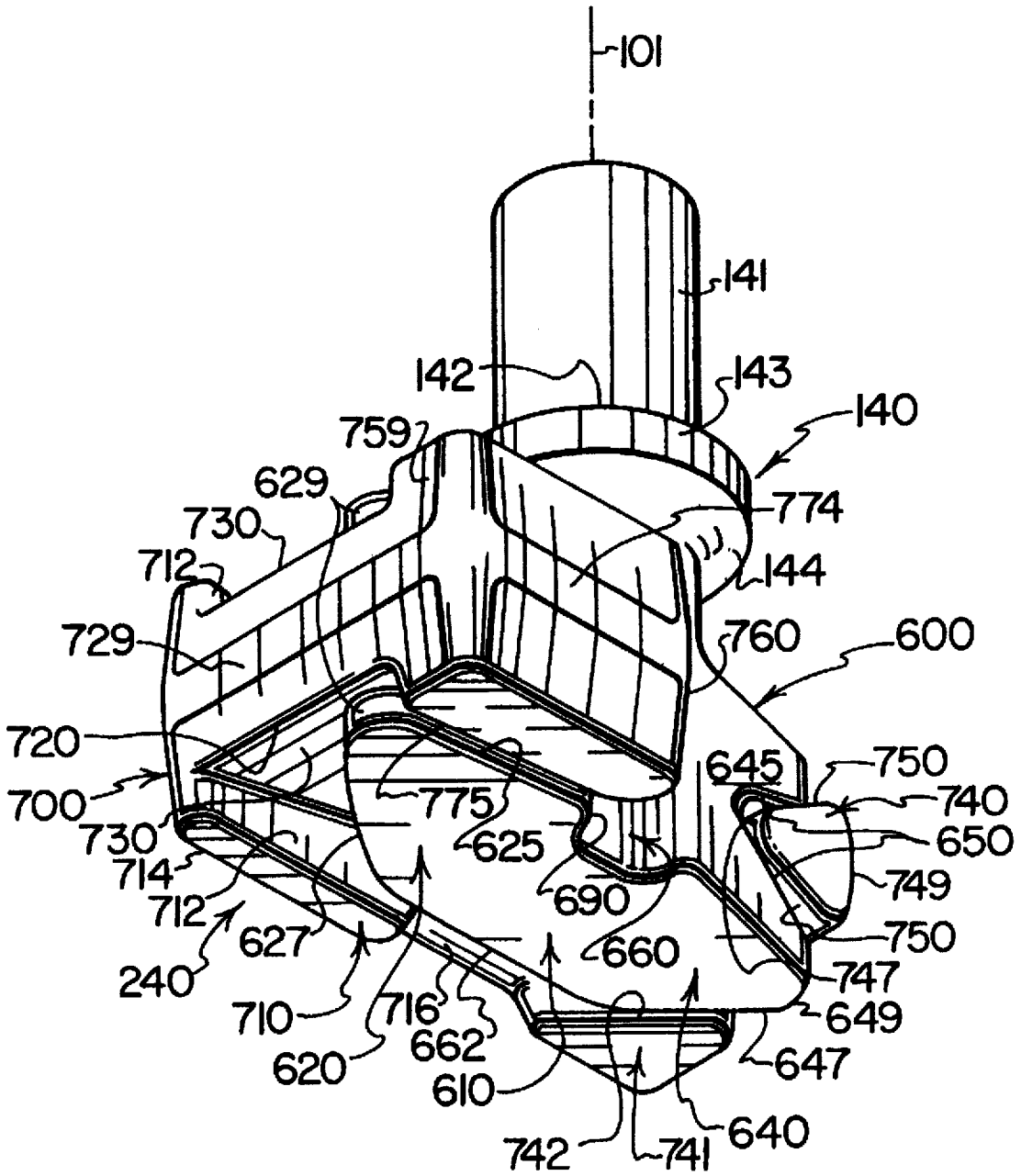
FIG. 9 is a perspective view showing the lower cam and keeper members in full latching engagement, it being noted by comparing FIGS. 8 and 9 that the lower cam and keeper members have configurations that are mirror images of the upper cam and keeper members.

As is shown in FIGS. 3, 8 and 9, the latch members 130, 140 have stem portions 131, 141 that are configured to extend into the tubular interiors of the upper and lower end regions 122, 124 of the lock rod 120 so that the latch members 130, 140 will have a mechanical connection to the lock rod 120 that can be secured as by welding. Circumferentially extending flanges 133, 143 of the latch members 130, 140 overlie and underlie the upper and lower end regions 122, 124, respectively. More specifically, the flange 133 has upper and lower shoulders 132, 134, with the lower shoulder 134 overlying the upper end region 122 of the lock rod 120; and, the flange 143 has upper and lower shoulders 142, 144, with the upper shoulder 142 underlying the lower end region 124 of the lock rod 120.

Referring to FIG. 1, the door control mechanism 100 also includes upper and lower keeper members 230, 240 that are configured to receive and cooperatively engage the cam type latch members 130, 140, respectively, in closing the door 60, in latching and retaining the door 60 closed, in resisting racking of the door 60 and its surrounding door frame (upper and lower portions of which are designated by the numerals 30 and 40), and in breaking the door 60 open. These and other features and characteristics of the interaction of the cam and keeper members 130, 140 and 230, 240 will be described in greater detail later herein.

The lock rod 120 preferably is formed from seam-welded steel tubing that preferably has been corrosion protection coated by its manufacturer, for example by applying a zinc/chromate/polymer coating thereto under optimal conditions that permit a high quality corrosion resistant finish to be applied, usually at a time before the newly manufactured tubing has been cut to length. A process by which steel tubing can be galvanized to provide a high quality zinc coating is described in expired U.S. Pat. No. 3,927,816. A process by which a chromate conversion coating followed by an application of clear organic coating such as a thermosetting polymer can be applied to zinc plated tubing is described in expired U.S. Pat. No. 3,790,355. Other commercially practiced protective coating processes that provide zinc/chromate/polymer coatings also can be used.

Referring to FIG. 3, the lock rod 120 may be defined by a single, full-length tubular member, or may be defined by two shorter tubular members that are arranged end-to-end and rigidly connected to thereby provide a full length lock rod. The reference numeral 120 refers to the entire length of the lock rod—which extends from the upper end region 122 to the lower end region 124. If two lock rod elements are to be used to define a full length lock rod 120, they have lengths that are selected so that their end-to-end juncture is located centrally within the confines of the steel sleeve 150.

Because the door control mechanism 100 will not differ in appearance regardless of whether a single, full length steel tube is used to form the lock rod 120 or whether the lock rod 120 is formed from two shorter tubular elements, there is no need to provide a separate set of drawing views to distinguish the appearances of one-element and two-element lock rods. Therefore, in FIG. 3, the numeral 120U can be thought of as designating either upper portions of a one-element lock rod or an upper of element of a two-element lock rod (which extends upwardly from centrally within the sleeve 150 to the downwardly facing shoulder 134 of the upper latch member 130); and, the numeral 120L can be thought of as designating either lower portions of a one-element lock rod or a lower element of a two-element lock rod (which extends downwardly from centrally within the sleeve 150 to the upwardly facing shoulder 142 of the the lower latch member 140).

Figure 7:
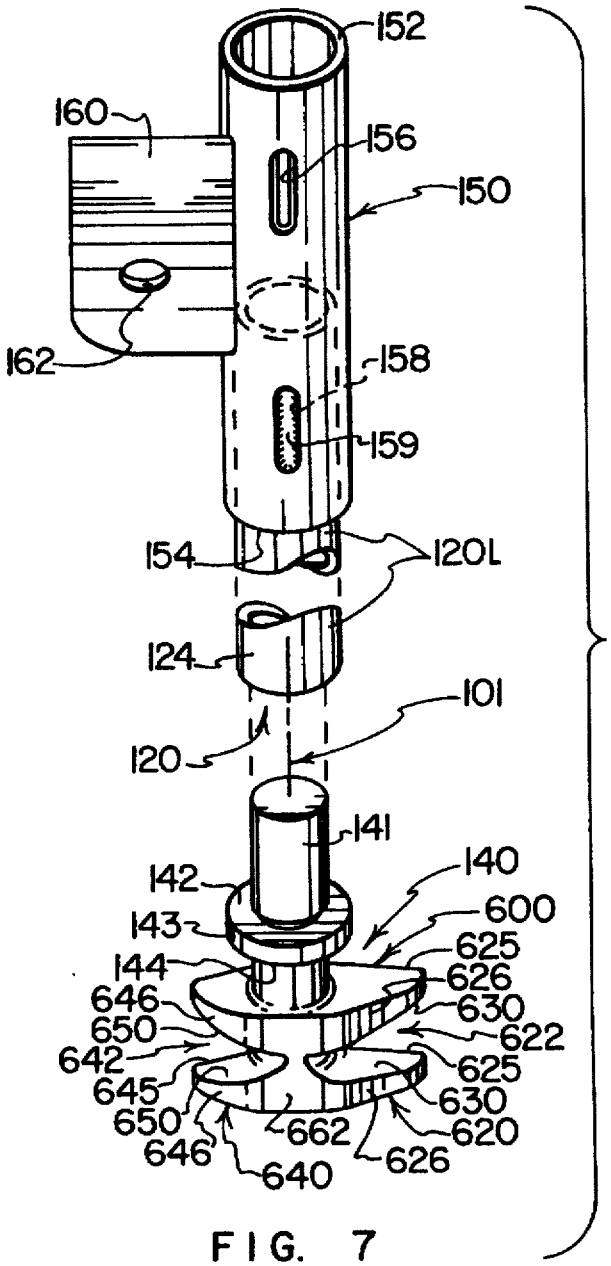
FIG. 7 is an exploded perspective view, on an enlarged scale, showing rear features of selected lower components of the rod lock assembly.

Referring to FIGS. 1–3 and 7, the sleeve 150 has an upwardly facing end surface 152 and a downwardly facing end surface 154. Referring to FIG. 7, a pair of axially spaced, identically configured, elongate slots 156, 158 are formed through the back side of the sleeve 150 for providing locations where welds can be formed to securely connect the sleeve 150 to the lock rod 120. For example, an elongate weld 159 is formed within the confines of the slot 158 (substantially filling the slot 158) to connect the sleeve 150 to the lower lock rod portion 120L; and, an identical elongate weld (not shown) normally is formed within the confines of the slot 156 to connect the sleeve 150 to the upper lock rod portion 120U (once a lower end of the upper lock rod portion 120U has been inserted half-way down into the sleeve 150 to abuttingly engage in end-to-end relationship the upper end of the lower lock rod portion 120L which is depicted in phantom in FIG. 7).

If the lock rod 120 is formed from a single, full-length reach of steel tubing, the weld 159 formed in the slot 158, and the identical weld (not shown) formed in the slot 156 will securely connect the sleeve 150 to the one-piece lock rod 120. If the lock rod 120 is formed from separate lower and upper lengths of tubing 120L, 120U, respectively, the described welds will enable the welded-in-place sleeve 150 to provide a secure connection between the lower and upper lock rod elements 120L, 120U.

Referring to FIGS. 1, 3 and 7, a U-shaped handle mounting bracket 160 is welded to the outside surface of the sleeve 150. The bracket 160 provides a mount that supports an elongate operating handle 170 (see FIG. 1) that is used to apply force to the lock rod 120 to pivot the lock rod 120, whereby the lock rod 120, in turn, correspondingly pivots the upper and lower latch members 130, 140. A fastener 172 extends through a hole 162 (see FIG. 7) formed in the bracket 160 and through an aligned hole (not shown) formed in one end region of the handle 170 to connect the handle 170 to the bracket 160. A handle retainer assembly 175 (see FIG. 1) of conventional form is mounted on the door 60 for receiving and releasably retaining the handle 170 to secure the door closure mechanism 100 in the locked position depicted in FIG. 1—wherein the door control mechanism 100, in turn, secures the door 60 closed.

Referring to FIGS. 1–3, four bearing assemblies 410, 420, 430, 440 are mounted on the door 60 and serve to journal the lock rod 120 for pivotal movement about an imaginary pivot axis 101 that extends centrally along the length of the lock rod 120. The bearing assemblies have stamped steel covers 310, 320, 330, 340, respectively. The bearing assemblies 410, 420 are located between the upper bearing assembly 430 and the lower bearing assembly 440.

The bearing assembly 410 has a stamped, strap-like steel cover 310 that defines upper and lower surfaces 312, 314, respectively, and that is connected to the door 60 by two bolts 315. The bearing assembly 420 has a stamped, strap-like steel cover 320 that defines upper and lower surfaces 322, 324, respectively, and is connected to the door 60 by four of bolts 325. The upper bearing assembly 430 has a complexly configured, stamped steel cover 330 that defines upper and lower surfaces 332, 334, respectively, and that is connected to the door 60 by four bolts 335. The lower bearing assembly 440 has a stamped steel cover 340 that is identical to the upper cover 330 but is inverted, that defines upper and lower surfaces 342, 344, respectively, and that is connected to the door 80 by four bolts 345.

The positioning of the bearing assembly 410 is not especially critical inasmuch as the purpose principally served by the bearing assembly 410 is that of stabilizing the lock rod 120 at a location generally mid-way between the bearing assemblies 420, 430 to ensure that the lock rod 120 does not deflect from its center axis 101, and to ensure that portions of the door 60 that are connected to the lock rod 120 by the bearing assembly 410 do not move relative to each other. The positioning of the bearing assemblies 420, 430, 440, on the other hand, is of some importance inasmuch as certain racking resistant features of the door control mechanism 100 derive, in part, from ensuring that the bearing covers 320, 330, 340 are properly positioned.

To enhance the racking resistance of a rod lock type of door control mechanism, there are two types of relative movements that one can try to prevent. One is relative movement between the lock rod 120 and the upper and lower door frame portions 30, 40. Preventing this type of relative movement depends in large measure on the character and success of the interaction that takes place between the upper cam and keeper members 130, 230, and the interaction that takes place between the lower cam and keeper members 140, 240—a subject that will be treated later herein in conjunction with a more detailed description of the configuration and operation of the cam and keeper members 130, 140 and 230, 240.

The other type of movement that one seeks to prevent is relative movement between the lock rod 120 and the door 60—a subject that is dealt with in some detail in the referenced First Parent Case, and also is dealt with next in the present document inasmuch as the door control mechanism 100 preferably utilizes these racking resistant features in combination with cam and keeper features (described later herein) to deal effectively with both of these undesirable types of racking movements. If the cam and keeper members 130, 140 and 230, 240 can function well in preventing relative axial movement between the lock rod 120 and the door frame portions 30, 40, and if the racking resistant features that are about to be described can function well in preventing relative axial movement between the lock rod 120 and the door 60, the net effect is to provide good racking resistance that will successfully oppose relative movements between the door frame portions 30, 40 and the door 60.

In accordance with features that form the subject of the First Parent Case, relative movement between the lock rod 120 and the door 60 are sought to be prevented by utilizing a set of "in series engagements" between lock-rod-connected components and door connected components, with correct positioning of the bearing covers 320, 330 and 340 being of importance in carrying out this objective.

By way of a first example, the sleeve 150 is sandwiched between the bearing covers 320, 340, with the top surface 152 of the sleeve 150 engaging the bottom surface 324 of the cover 320, and with the bottom surface 154 of the sleeve 150 engaging the top surface 342 of the cover 340—which arrangement constitutes a first paired set of surface engagements (i.e., a first bearing-cover-related arrangement of paired surface engagements) that is utilized by the door control mechanism 100 to prevent both relative upward and relative downward axial movements of the lock rod 120 with respect to the door 60. Stated in another way, the sandwiching of the sleeve 150 by the bearing covers 320, 340 is the first of three racking resistant features relied upon, in combination, by the door control mechanism 100 to prevent relative axial movement of door connected and lock-rod-connected components.

By way of a second example, the lower bearing cover 340 is sandwiched between the sleeve 150 and the lower latch member 140, with the top surface 342 of the lower bearing cover 340 engaging the bottom surface 154 of the sleeve, and with the bottom surface 344 of the lower bearing cover 140 engaging the top surface 142 of the lower latch member 140—which arrangement constitutes a second paired set of surface engagements (i.e., a second bearing-cover-related arrangement of paired surface engagements) that is utilized by the door control mechanism 100 to prevent both relative upward and relative downward axial movements of the lock rod 120 with respect to the door 60. Stated in another way, the sandwiching of the lower bearing cover 340 by the members 140, 150 is the second of three racking resistant features relied upon, in combination, by the door control mechanism 100 to prevent relative axial movement of door connected and lock-rod-connected components.

By way of a third example, the upper bearing cover 330 has an upper surface 332 which is held in engagement with the lower surface 134 of the upper cam member 130, and the lower bearing cover 340 has a lower surface 344 that is held in engagement with the upper surface 142 of the lower cam member 140—which arrangement constitutes a third paired set of surface engagements (i.e., a third bearing-cover-related arrangement of paired surface engagements) that is utilized by the door control mechanism 100 to prevent both relative upward and relative downward axial movements of the lock rod 120 with respect to the door 60. Stated in another way, the sandwiching of the door-interconnected upper and lower bearing covers 330, 340 by the flanges 133, 143 of the upper and lower cam members 130, 140 is the third of three racking resistant features relied upon, in combination, by the door control mechanism 100 to prevent relative axial movement of door connected and lock-rod-connected components.

Looking more closely at the limited number of components that are employed in defining all three of the above described paired sets of racking resistant features, it will be seen that, only three lock-rod-carried elements (namely the cam members 130, 140 and the sleeve 150) and only three door-carried elements (namely the bearing covers 320, 330, 340) are utilized in forming all three of the described "sandwichings" of components. The use of so few components to achieve rather a lot of anti-racking capability is possible due to the in-series, in-line positioning of four of the essential elements, namely the lower cam member 140, the lower bearing cover 340, the sleeve 150 and the bearing cover 320—which are arranged in series in engagement one-with-the-next, with no intermediate spaces interposed between any two adjacent pairs of these four elements.

This is an unusually economical approach that maximizes the use that can be made of a limited set of simple components to achieve a powerful degree of "anti-racking" capability, and largely boils down to a matter of providing the lock rod with a double-ended sleeve 150, and then utilizing the sleeve 150 and the cam members 130, 140 to provide racking resistance by strategically positioning the three bearing covers 320, 330, 340 to engage the lock-rod-carried members 130, 140, 150.

Additional features of the door control mechanism 100 that also are brought out in the referenced Parent Cases reside in the use that is made by each of the bearing assemblies 410, 420, 430, 440 of plastic bearing liners (indicated generally by the numeral 500 in FIGS. 4 and 5) that feature some novel points of design. To begin with, while the bearing covers 310, 320, 330, 340 may differ one from another in configuration, identically configured enlarged regions 317, 327, 337, 347 are defined by the bearing covers 310, 320, 330, 340 so that identically configured plastic bearing liners 500 can be housed by the enlarged regions 317, 327, 337, 347.

Figure 4:
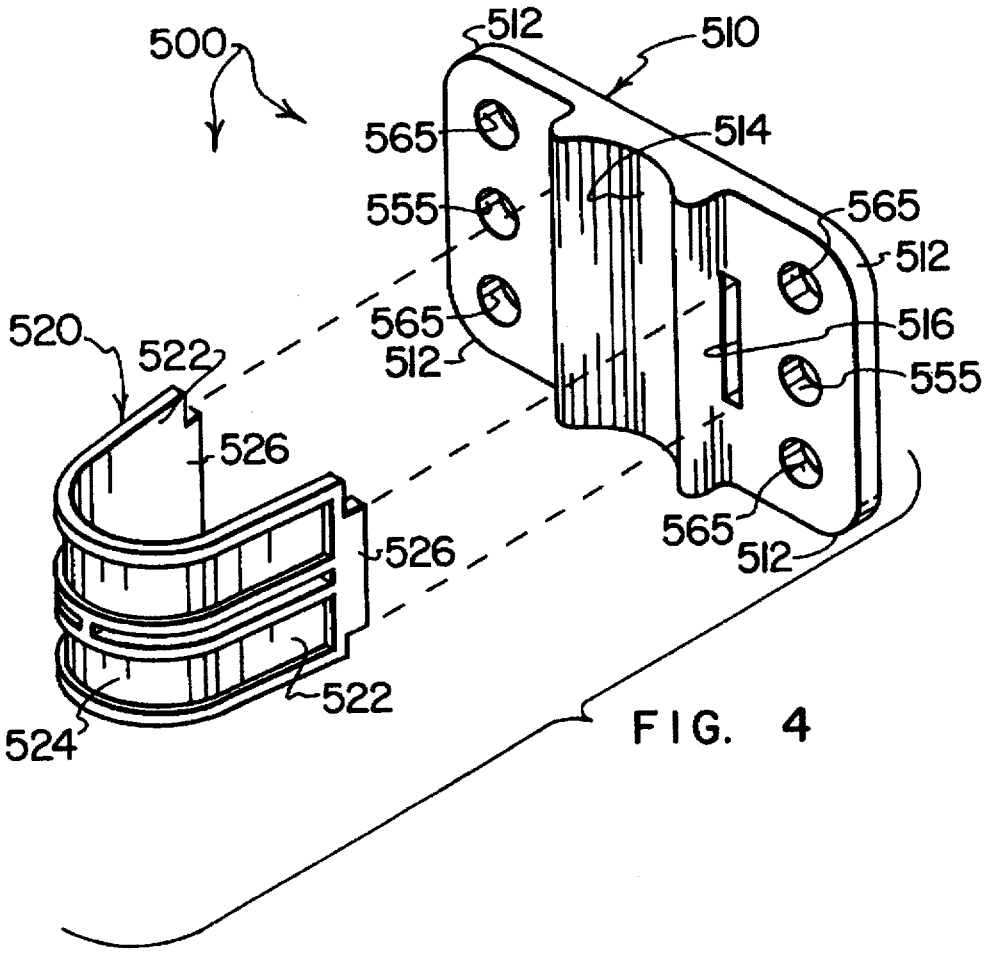
FIG. 4 is an exploded perspective view, on an enlarged scale, showing components of one of the plastic bearing liner assemblies.
Figure 5:
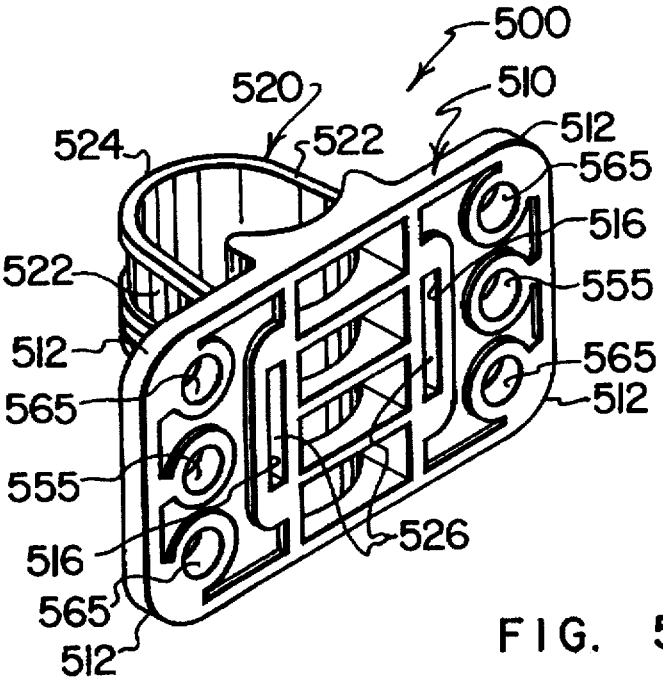
FIG. 5 is a perspective view on the same scale as FIG. 4 showing principally rear features of the plastic bearing liner components when assembled.

Referring to FIGS. 4 and 5, each of the bearing liners 500 includes a pair of components that mate when assembled to provide lock rod bearings of good integrity. A plate-like component 510 that is of generally rectangular shape except that its corners 512 are generously rounded. A U-shaped component 520 has opposed leg portions 522 that are interconnected by a C-shaped portion 524. Projections 526 of generally rectangular cross-section are carried at the distal ends of the leg portions 522, and are configured to be snugly received with generally rectangular openings 516 (see FIGS. 5 and 6) formed in the plate-like component 510. A sizable arcuate surface 514 is defined by the plate-like component 510 and is located between the openings 516.

Figure 6:
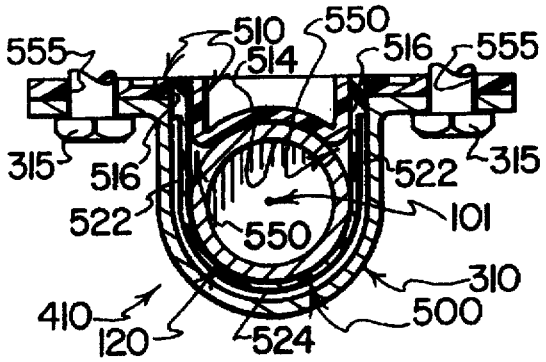
FIG. 6 is a sectional view, on an enlarged scale, as seen from a plane indicated by a line 6—6 in FIG. 1.

Referring to FIG. 6 wherein one of the liners 500 is shown in cross-section housed within the enlarged region 317 of the bearing cover 310, arcuate surface 514 and the C-shaped portion 524 have radii of curvature that match the outer diameter of the lock rod 120—thereby enabling the surface 514 and the C-shaped portion 524 to engage opposite sides of the lock rod 120 so as to confine the rotation of the lock rod to an axis (not shown) that is centered between the arcuate surface 514 and the inner face of the C-shaped portion 524.

A feature of the bearing liner assembly 500 that is best seen in FIG. 6 is that vertical passages, indicated generally by the numerals 550, are provided near junctures of the arcuate surface 514 with the leg portions 522. The vertical passages 550 aid in ducting foreign matter downwardly for discharge from the bearing assemblies 410, 420, 430, 440, and thereby help to ensure that the bearing assemblies 410, 420, 430, 440 smoothly journal the lock rod 120 for a service life of good longevity.

Four "corner" mounting holes 565, and two "center" mounting holes 555 are formed through the plate-like component 510. The four corner holes 565 receive the four bolts 325 that are used to bolt the bearing cover 320 to the door 60. The two center holes 555 receive the two bolts 315 that are used to bolt the bearing cover 310 to the door 60. The cover 320 employs a total of four bolts 325 because it is an "anti-racking" component (as is described above) that may be axially loaded in the presence of forces that tend to cause racking. The cover 310 employs only the two bolts 315 because it is not subjected to axial loadings and does not perform an "anti-racking" function.

In preferred practice, the rear and front components 310, 320 are formed from a substantially rigid, strong, crack resistant plastics material using extrusion molding techniques. Because door control assemblies need to operate smoothly in ambient temperatures typically extending from below zero degrees Fahrenheit (and sometimes in the presence of severe ice buildup) to above one hundred degrees Fahrenheit, selection of a plastics material that is serviceable in a wide range of temperatures and that resists "freeze up" during cold winter days is desirable. As those who are skilled in the art will readily understand, a variety of plastics materials suitable for this purpose are commercially available. An acetal resin sold by E.I. DuPont deNemours & Co., Wilmington, Del. 19898 under the registered trademark "DELRIN 500" is, for example, a good commercially available choice.

In preferred practice, the door control mechanism 100 preferably is provided with a desired degree of corrosion resistance by 1) protectively coating the lock rod 120 (or the upper and lower components 120U, 120L that are to be assembled to form the lock rod 120) prior to cutting the lock rod to length, and prior to welding and to the carrying out of other significant assembly effort, with the application of protective coating being carried out under optimal conditions, preferably in the facility of the manufacturer of the rod, and preferably utilizing what has been described herein as a zinc/chromate/polymer coating; 2) protectively coating the latch members 130, 140 and the steel sleeve 150 separately, preferably also under optimal conditions, also at a time prior to assembly; 3) welding the cam members 130, 140 to the lock rod 120 utilizing small elongate welds located so that they normally are hidden; and, 4) applying touch-up spray of the type described previously to form a zinc-rich polymer containing film in limited areas where metal surface was exposed when the lock rod was cut to length, and in limited areas where the elongate welds were formed, with the touch-up coating being of a type that matches as closely as possible the finished appearance of other corrosion resistant coating applied to adjacent surface areas.

Much of what has been described above forms the subject matter of the referenced Parent Cases, with the First Parent Case having to do with the anti-racking capabilities that derive from the described positioning of door connected and lock-rod-carried components to minimize relative movements between the lock rod 120 and the door 60, and with the Second Parent Case having to do with provision of the described corrosion resistant features—all of which preferably are utilized in conjunction with features of the cam members 130, 140 and the keeper members 230, 240 that now will be described.

As a starting point, the cam members 130, 140 have features of "similarity" and "symmetry" that should be noted; and, the keeper members 230, 240 have features of "symmetry" and "identity" that also should be taken into account.

Figure 10:
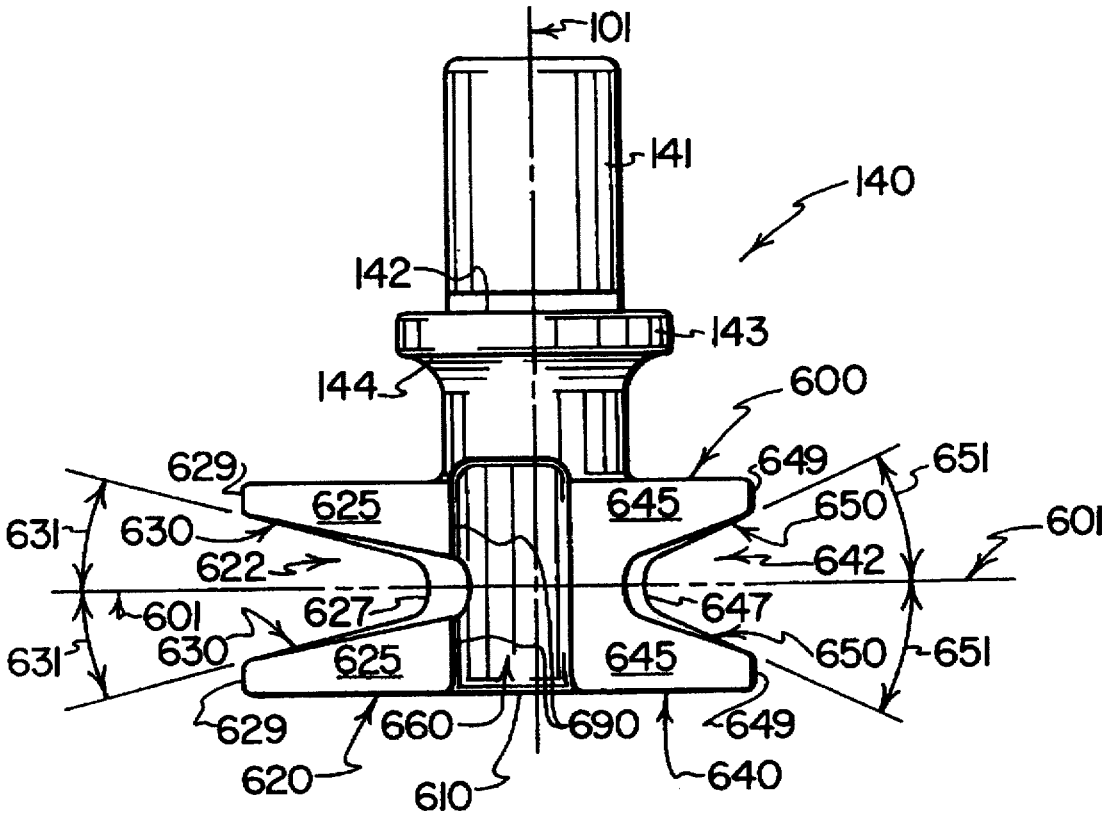
FIG. 10 is a front elevational view showing the lower cam member.

Referring to FIGS. 8, 9 and 10, the cam members 130, 140 are similar in that they have configurations that are top-to-bottom mirror image reversals of each other. The cam members 130, 140 also have body portions 600 that are symmetrical about an imaginary center plane, which plane is designated (for the cam 140) by the numeral 601 in FIG. 10. Stated in another way, if the cam members 130, 140 did not have stem portions 131, 141 that extend away from the body portions 600 along the axis 101, the cam member 140 would be completely symmetrical about the center plane 601 and would, in fact, be completely identical to the cam member 130. Thus, the cam member bodies 600 are identical one with another, and each is symmetrical about its center plane (such as the center plane 601 shown in FIG. 10); the cam member stems 131, 141 are mirror image reversals of each other; and, one way of looking at the only real difference that exists between the cam members 130, 140 is to note that the cam members 130, 140 are identical except that the cam member 130 has its stem portion 131 extending downwardly from its body 600, whereas the cam member 140 has its stem portion 141 extending upwardly from its body 600.

Figure 11:
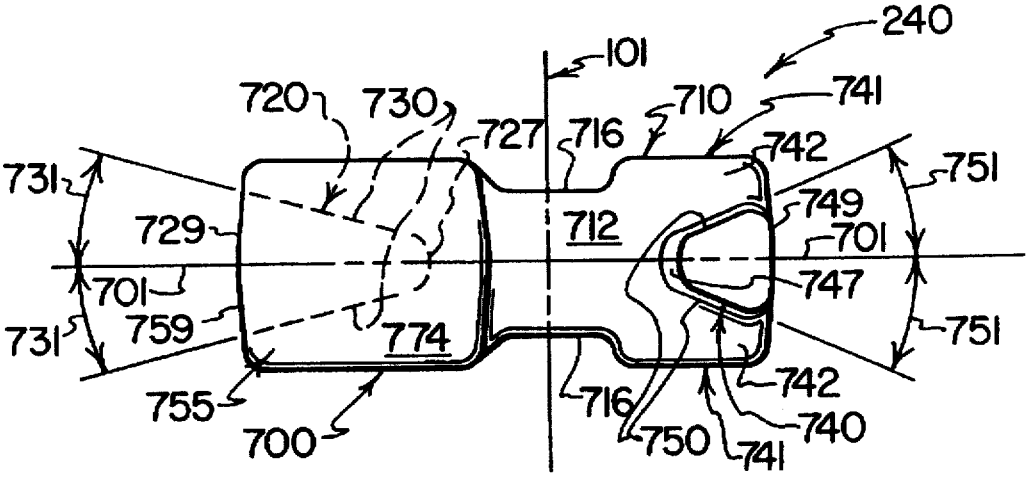
FIG. 11 is a front elevational view showing the lower keeper member, with a hidden, wedge shaped post portion thereof depicted by a broken line.

Referring to FIGURE to FIGS. 8, 9 and 11, the keeper members 230, 240 have bodies 700 that are symmetrical about an imaginary center plane, which plane is designated (for the cam 240) by the numeral 701 in FIG. 11. While one could observe that the keeper members 230, 240 (like the cam members 130, 140) are "top-to-bottom mirror image reversals" of each other, one can observe more simply that the keeper members 230, 240 have configurations that are, in fact, completely identical one with another.

Referring to FIGS. 8–11, each of the cam members bodies 600 has a central portion 610 that is intersected by the pivot axis 101, with a relatively long arm 620 and a relatively short arm 640 extending in generally opposite directions from the central portion 610. Stated in another way, the long arm 620 and the short arm 640 extend in generally opposite directions relative to the axis 101. The long and short arms 620, 640 define separate long and short V-shaped notches 622, 642, respectively, that open as they extend generally away from the axis 101. As is best seen in FIG. 10, the long V-shaped notch 622 has its opposite sides defined by primary engagement surfaces 630 that are relatively gently inclined relative to the plane 601 at angles 631 of about fifteen degrees. The short V-shaped notch 642 has its opposite sides defined by secondary engagement surfaces 650 that are more steeply inclined relative to the plane 601 at angles 651 of about twenty-five degrees.

Figure 12:
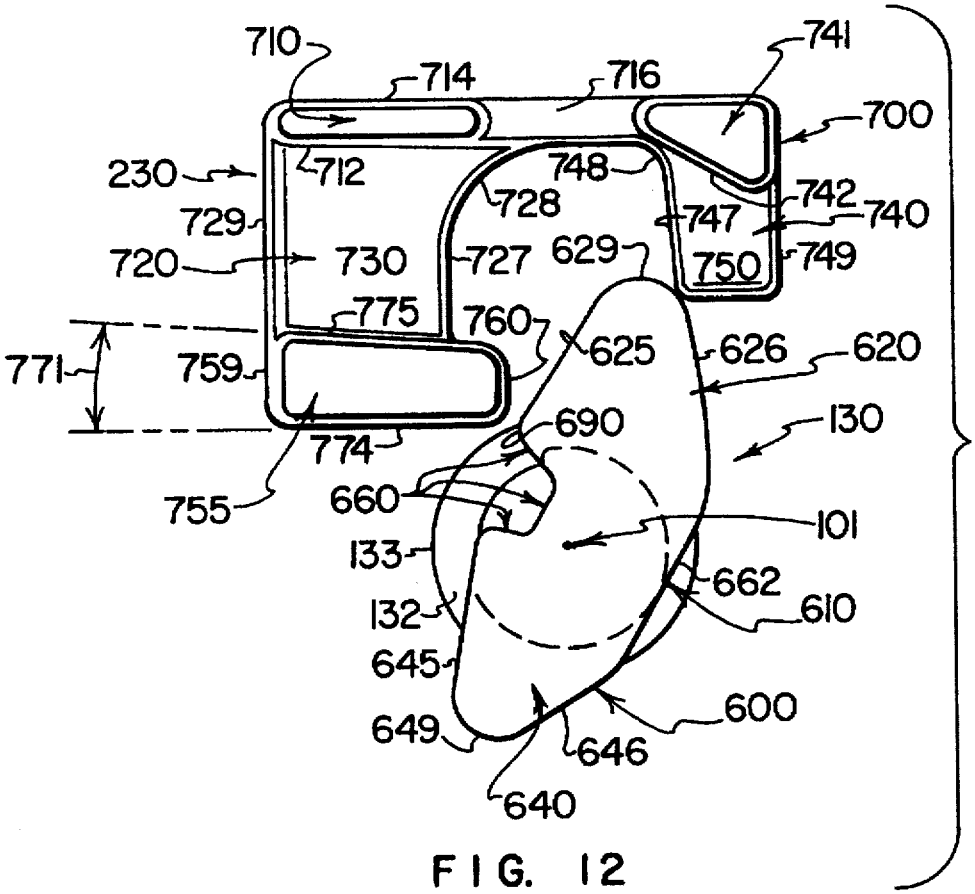
FIG. 12 is a top plan view showing the upper cam and keeper members in a typical position assumed by these members as they are about to be brought into latching engagement.

Referring to FIGS. 8 and 10 where front portions of one of the cam bodies 600 are depicted, to FIG. 7 wherein rear portions of one of the cam bodies 600 is depicted, and to FIG. 12 wherein portions of one of the cam bodies 600 is shown as viewed "on end," the long arm 620 has a generally flat front and rear surface portions 625, 626 that are inclined relatively to each other to define a wedge shape that narrows as the front and rear surface portions 625, 626 extend toward and are are joined by rounded end surface portions 629; the short arm 640 has generally flat front and rear surface portions 645, 646 that are inclined relatively to each other to define a wedge shape that narrows as the front and rear surface portions 645, 646 extend toward and are are joined by rounded end surface portions 649; a vertically extending U-shaped recess 660 is provided at the junctures of the front surface portions 625, 645; and relatively flat back wall portions 662 join the rear surface portions 626, 646. Referring to FIGS. 10 and 12, the U-shaped recess 660 is offset slightly toward the long-arm side of the pivot axis 101.

Figure 13:
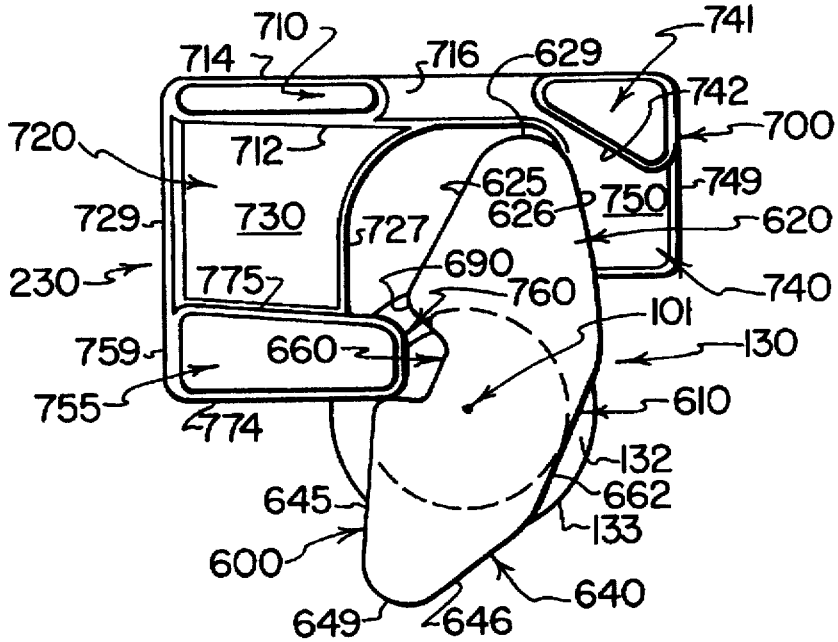
FIG. 13 is a top plan view similar to FIG. 12 showing a U-shaped notch of the upper cam member receiving and engaging portions of a post-carried head formation of the upper keeper member during pivoting of the upper cam into latching engagement with the upper keeper.

Referring to FIGS. 8, 9, 11 and 12, each of the keeper bodies 700 has a "base" that is defined by a relatively thin, elongate rear wall 710 having relatively flat front and rear surfaces 712, 714. As is best seen in FIGS. 12 and 13, the flat front and rear surfaces 712, 714 of the rear wall 710 (of the base of each of the keeper bodies 700) substantially parallel each other—and, the thin, flat, elongate rear wall 710 (of the base of each of the keeper bodies 700) can be thought of as defining a so-called "base plane" of the associated keeper body 700. The rear wall 710 is of generally rectangular shape except that, about midway along its length, opposite edges of the rear wall have inset portions 716 (best seen in FIGS. 8 and 11) that provide locations where welds may be formed (not shown) for connecting the keeper body 700 to one of the door frame portions 30, 40 (depicted only in FIG. 1).

Referring to FIG. 11, two spaced posts 720, 740 extend forwardly from opposite end regions of the rear wall 710. The posts 720, 740 are of generally wedge-shaped cross-section (i.e., they each have a generally triangular cross section) defined, in part, by inclined primary engagement surfaces 730 that are located on opposite sides of the post 720, and by inclined secondary engagement surfaces 750 that are located on opposite sides of the post 740. The primary engagement surfaces 730 extend symmetrically about the center plane 701 at relatively gentle angles of inclination 731 that are selected to match the fifteen degree angles of inclination 631 of the primary engagement surfaces 630 of the cam body 600 (depicted in FIG. 10). The secondary engagement surfaces 750 extend symmetrically about the center plane 701 at relatively steeper angles of inclination 751 that are selected to match the twenty-five degree angles of inclination 651 of the secondary engagement surfaces 650 of the cam body 600 (depicted in FIG. 10).

Continuing to refer to FIG. 11, the primary engagement surfaces 730 are joined by a rounded inner end surface 727, and by a generally flat (or only slightly curved) outer end surface 729. Similarly, the secondary engagement surfaces 750 are joined by a rounded inner end surface 747, and by a generally flat (or only slightly curved) outer end surface 749.

Referring to FIG. 12, the rounded inner end surface 727 executes a relatively large radius curve 728 to join with the front surface 712 of the rear wall 710; and, the rounded inner end surface 747 executes a relatively small radius curve 748 to join with the front surface 712. The spacing between the inner end surfaces 727, 747 is selected such that the inner end surfaces 727, 747 can be received in narrow rounded end regions 627, 647 (see FIG. 10) of the V-shaped notches 622, 642 during movements of the cam body 600 into and out of latching engagement with the keeper body 700, which movements will be described shortly in conjunction with a discussion of FIGS. 12–15.

Referring to FIG. 8, wedge-shaped formations 741 are defined along opposite sides of the post 740 where the post 740 joins with the rear wall 710. The wedge-shaped formations 741 have inclined, forwardly facing surfaces 742 that join smoothly with the front wall 712 of the rear wall 710.

Referring to FIGS. 8, 11 and 12, an enlarged head formation 755 is formed at the forward end of the post 720. The head formation 755 has front and rear surface portions 774, 775 that extend between outer and inner end surfaces 759, 760. While the outer end surface 759 aligns with and is effectively an extension of the outer end surface 729 of the post 720, the inner end surface 760 extends more closely toward the center axis 101 (as viewed in FIG. 11) than does the rounded inner end surface 727 of the post 720. While the front surface portions 774 are relatively flat and extend substantially parallel to the front and rear surfaces 712, 714 of the rear wall 710, the rear surface portions 775 are inclined at a small angle 771 (see FIG. 12) of only about five degrees relative to the generally parallel planes of the front surfaces 712, 774.

The manner in which one of the cam bodies 600 is moved into and out of latching engagement with one of the keeper bodies 700 now will be discussed in conjunction with FIGS. 12–15. Referring to FIG. 12, when latching engagement is to be initiated, the lock rod 120 is caused to pivot the cam bodies 600 so that the long arms 620 are pointed into the space defined between the keeper posts 720, 740. Referring to FIG. 13, as the cam body 600 is rotated counterclockwise about the rearwardly moving pivot axis 101 to latchingly engage the keeper body 700, the inner end region 760 of the enlarged head formation 755 is received within the U-shaped recess 660 of the cam body 600.

The extension rightwardly (as viewed in FIGS. 12–15) of the inner end region 760 of the keeper body 700 is of importance in defining the shape, location and operation of an "abutment surface" 775 of the keeper, as will be brought out shortly. What may be observed by comparing the depictions of FIGS. 12 and 13 is that, because the inner end region 760 extends rightly as far as it does, the presence of the U-shaped recess is rendered necessary for, without the recess 660 to receive and wrap about the rightwardly projecting end region 760, it would not be possible to move the cam body 600 toward and into latching engagement with the keeper body 700.

Figure 14:
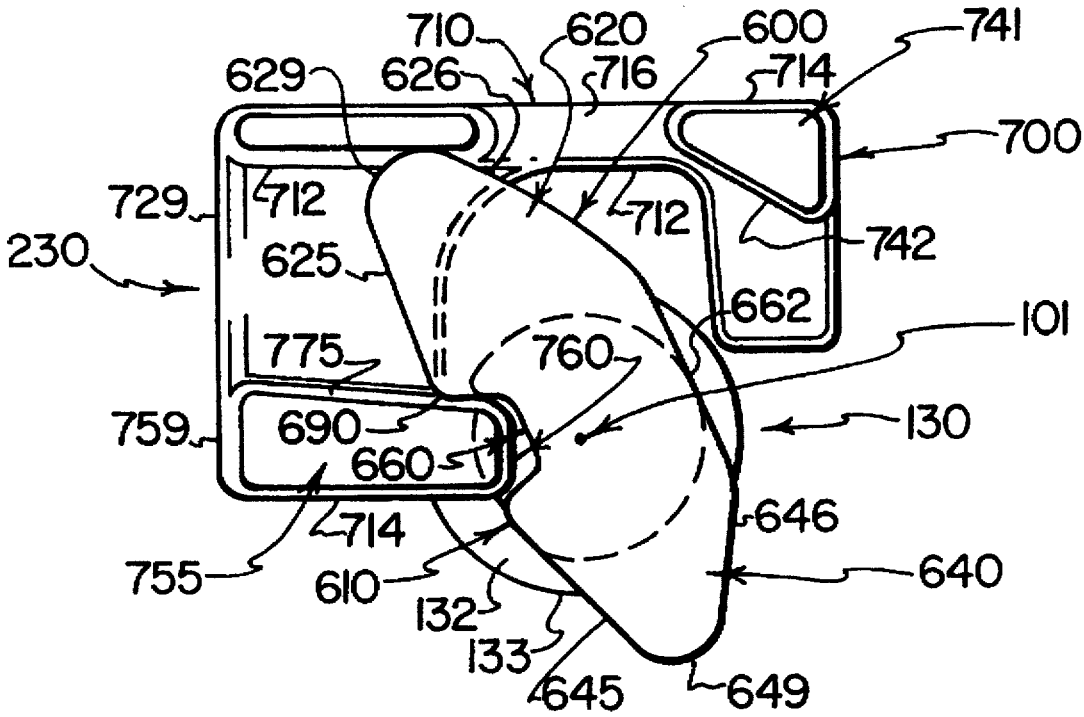
FIG. 14 is another top plan similar to FIG. 13 but showing further rotation of the upper cam member as the upper cam and keeper members are being pivoted into latching engagement; and, FIG. 15 is still another top plan view showing the upper cam and keeper members in full latching engagement.

Referring to FIG. 14, as the cam body 600 continues to rotate counterclockwise about the pivot axis 101, the U-shaped recess 660 "wraps about" the inner end 760 of the head formation 755 to bring a rounded portion 690 of the cam body 600 (located at the juncture of the U-shaped recess 660 and the front surface 625 of the long arm 620) into engagement with the rear surface 775 of the head formation 755 to force the cam body 600 to continue to move rearwardly (to force closed the door 60 to which the cam body 600 is connected by the lock rod 120). At the same time that engagement of the rounded portion 690 of the cam body 600 with the rear surface 775 is forcing the door 60 closed, the progressively greater engagement that is being caused to take place between the primary engagement surfaces 630, 730 (as the wedge-shaped post 720 is received to greater depths within the V-shaped notch 622) will cause relative axial movement (along the pivot axis 101) that will eliminate any misalignment that may be present of the center planes 601, 701 of the cam and keeper bodies 600, 700 so that any vertical misalignment that may exist between the cam and keeper bodies 600, 700 will thereby be corrected as the door 60 is closed.

As continued counterclockwise rotation of the cam body 600 about the pivot axis 101 takes place, a progressive increasing degree of "latching engagement" may be said to result that culminates when the cam body 600 is brought into what is referred to herein by such interchangeable terms as "a position of full latching engagement" or, more simply, "fully latched engagement" with the keeper body 700—it being understood that, as a position of full latching engagement is reached by the cam and keeper bodies 600, 700, the door 60 is concurrently brought to its "fully closed and latched position," also referred to herein as its "fully closed position."

Figure 15:
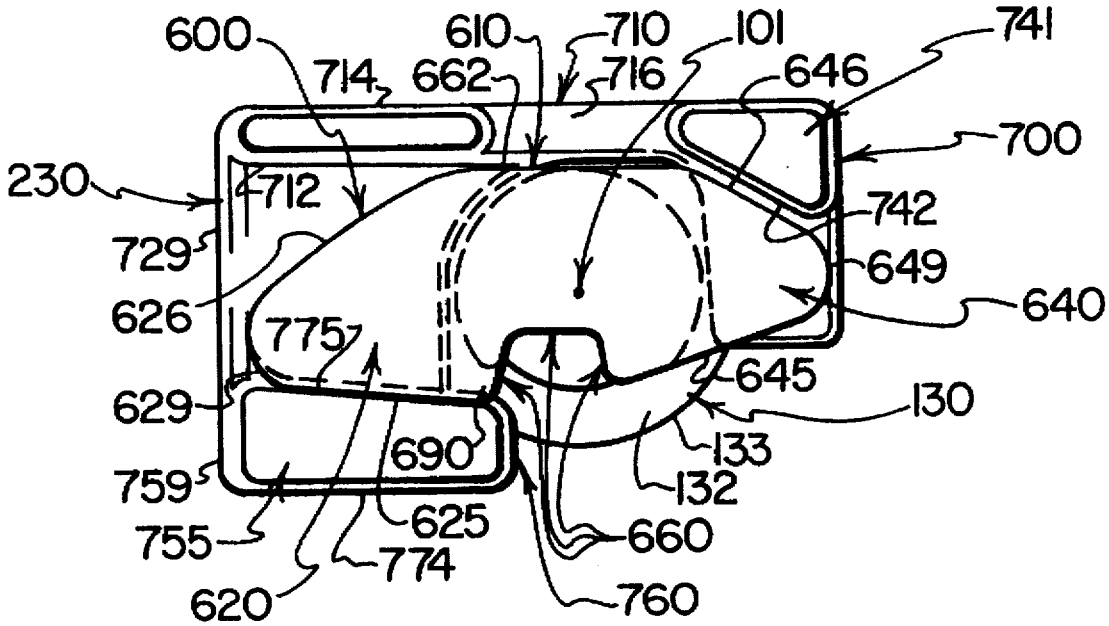

Referring to FIGS. 9 and 15 wherein a cam body 600 is shown in a position of full latching engagement with a keeper body 700, it will be seen 1) that the wedge-shaped cross-sections of the posts-720, 740 are fully received within the V-shaped notches 722, 744 so that the engagement of the primary engagement surfaces 630, 730 acting in concert with the engagement of the secondary engagement surfaces 650, 750 will function to strongly resist relative axial movement of the latchingly engaged cam and keeper bodies 600, 700 (whereby racking will be inhibited due to suppression of axial movements of the locking rod 120 relative to the door frame portions 30, 40); 2) that the rearwardly facing surface portions 646 of the short arm 640 are in engagement with the forwardly facing surface portions 742 of the wedge-shaped corner formations 741; and, 3) that the forwardly-facing flat surface 625 of the long arm 620 is fully engaging the rearwardly-facing flat surface 775 of the enlarged head formation 755.

The flat surfaces 625, 775 constitute "abutment surfaces" that engage when the cam and keeper bodies 600; 700 are fully latched. When engaged as depicted in FIG. 15, the abutment surfaces 625, 775 serve the important function of transmitting from the cams 130, 140 to the keepers 230, 240 major portions of door loading forces that are imposed the door 60 by shifting or shifted loads or the like (i.e., forces that tend to open the door 60 in opposition to the latched engagement of the cam and keeper bodies 600, 700); and, it is due in large measure to the engagement of the abutment surfaces 625, 775 that the door 60 is prevented from opening when it is latched closed.

Features of the present invention reside in the location, orientation and configuration of the abutment surfaces 625, 775—and in the fact that, when the door 60 is fully latched and closed, the abutment surfaces 625, 775 engage "one flat surface against the other."

The location of the abutment surfaces 625, 775 is quite close to the location of the pivot axis 101—which is due both to the fact that inner ends of the engaging surfaces 625, 775 extend rightwardly (as viewed in FIG. 15) toward the pivot axis 101, and to the very "compact" configurations of the cam and keeper bodies 600, 700 which, though elongate, tend to be shorter than are many proposed cam and keeper bodies that currently are in commercial use. Due to the advantageous location of the engaging abutment surfaces 625, 775, door loading forces that are transmitted between the engaged surfaces 625, 775 (by force components that extend normal to the plane of the engaged surfaces 625, 775) act through an unusually short moment arm in generating torque about the pivot axis—torque that is undesired and should be minimized because it tends to pivot the cams 130, 140 out of latching engagement with the keepers 230, 240. If the engaged surfaces 625, 775 were stationed at a greater distance from the pivot axis 101, force loadings of the same magnitude transmitted normally between the surfaces 625, 775 would act through a greater moment arm and would therefore tend to generate undesirable "unlatching torque" of correspondingly greater magnitude.

The orientation of the engaged abutment surfaces 625, 775 is in a plane that very nearly parallels the plane of the door 60 (i.e., the plane of engagement of the abutment surfaces 625, 775 is inclined relative to a plane in which the door frame portions 30, 40 and the closed door 60 extend by an angle of only about five degrees; which angle is designated in FIG. 12 by the numeral 771) is such that, when forces transmitted between the latched cam and keeper bodies 600, 700 are divided into segments that extend normal and tangential relative to the plane of engagement of the surfaces 625, 775, the tangential force components are of sufficiently minimal magnitude to not cause any significant unlatching movement of the cam and keeper bodies 600, 700.

The flat configuration of the abutment surfaces 625, 775 also is advantageous in that it does not confine force transmission to only limited areas of the abutment surfaces 625, 775, but rather tends to spread out force transmission across the full areas of engagement to minimize generation of force concentrations that tend to cause breakage of the cams 130, 140 and/or the keepers 230, 240. The use of the flat abutment surfaces 625, 775 differs from many prior proposals wherein engaging surfaces of differing radii of curvature often have been used, the effect of which is to relegate the transmission of forces between cams and keepers to relatively small surface areas where cam and keeper engagement actually takes place.

Referring once again to FIG. 14, as clockwise pivotal movement of the cams 130, 140 relative to the keepers 230, 240 takes place during "unlatching" of the cams 130, 140 and the keepers 230, 240, the rear surface 626 and the rounded end region 629 of the cam body 600 is brought into engagement with the front face 712 of the rear wall 710 of the keeper body 700 to force the axis 101 to move forwardly and out of the space located between the posts 720, 740—whereby a significant assist is provided in breaking open the door 60. As this "unlatching" rotation of the cams 130, 140 continues, the rounded end region 629 moves rightwardly along the front face 712 of the rear wall 710, the length of the long arm 620 is extended against the front face 712, and the axis 101 is forced forwardly (as in FIG. 13) until the cam body 600 is no longer being restrained by the keeper body 700 (as in FIG. 15), hence door opening may continue.

While a variety of "orientation terms" such as "upwardly," "downwardly," forwardly," "rearwardly," "leftwardly," "rightwardly," "inwardly," "outwardly" and the like are used in this document, these terms should not be interpreted as being limiting. The door control mechanism 100 can be used in a wide variety of attitudes other than the vertically extending orientation that has been described; and the described cam and keeper features and interactions can be implemented in wide variety of orientations and arrangements.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A cam and keeper combination for a door control mechanism that can pivot a cam into and out of position of latching engagement with a keeper of the combination for securing a pivoted door in closed position, comprising:

a) the cam having a body for attachment to a pivoted locking rod for being pivoted by the locking rod about an imaginary central axis that extends through the body and generally centrally along the locking rod, with the cam having a first arm and a second arm that have inner end portions that join with the body, and outer end portions that project away from the body and away from the central axis in generally opposite first and second directions, respectively, and that are configured such that each is substantially symmetrically bisected by an imaginary first center plane that intersects perpendicularly with said central axis, with the first arm defining a generally V-shaped first notch, with the second arm defining a generally V-shaped second notch, with the first and second V-shaped notches being oriented so as to open away from each other and being configured such that each is substantially symmetrically bisected by the first center plane;

b) the keeper having a generally flat, elongate base with a rearward mounting surface and a forward surface on opposite sides thereof, with the base being centrally bisected along its length by an imaginary second center plane that extends generally perpendicular to a base plane defined by the generally flat, elongate base, with the keeper also having spaced first and second post formations that extend forwardly from the forward surface near opposite end regions of the elongate base, with the post formations having generally wedge-shaped cross-sections that are positioned and configured so as to be substantially symmetrically bisected by the second center plane and are oriented so that their wedge-shaped cross-sections point generally toward each other, with the wedge-shaped cross-sections having inner end formations that are separated by a space configured to receive the body of the cam therein, with the keeper additionally having an enlarged head formation carried by the first post formation at a location spaced forwardly from the forward surface of the elongate base, with the head formation having opposed portions that project away from opposite sides of the first post formation and having an inner end portion that projects away from the inner end formation of the first post formation so as to overlie said space and to overlie a portion of the cam body when the cam body is received within said space, and with the opposed portions of the head formation cooperating to define a substantially flat, rearwardly facing abutment surface that overlies such portions of the forward surface as extend along opposite sides of the first post formation and that overlies portions of said space; and, c) with the cam having a U-shaped recess formation defined near the juncture of the inner end portion of the first arm with the body that is configured to closely receive the inner end portion of the head formation therein and to drivingly engage the inner end portion of the head formation so that the U-shaped recess wraps closely about the inner end portion of the head formation when the cam is rotated about said central axis into latching engagement with the keeper and to effect movement of the central body portion of the cam into and out of said space during latching and unlatching engagement of the cam and the keeper, with the first arm being configured to bring opposed side surfaces of the first notch into engagement with opposed side surfaces of the first post formation as the cam is being rotated into latching engagement with the keeper, with the second arm being configured to bring opposed side surfaces of the second notch into engagement with opposed side surfaces of the second post formation as latching engagement is established between the cam and the keeper, and with the first arm defining a generally flat abutment surface that is caused to face forwardly and to seat flatly against the flat, rearwardly facing abutment surface of the head formation when the cam has been rotated about the central axis to a position of full latching engagement with the keeper.

2. The cam and keeper of claim 1 wherein the abutment surface of the head formation and abutment surface of the first arm have inner end portions that engage at a location overlying said space when the cam has been rotated to a position of full latching engagement with the keeper.

3. The cam and keeper of claim 1 wherein the flat abutment surface of the head formation and the flat abutment surface of the first arm are oriented by the cam and keeper such that, when the cam has been rotated to the position of full latching engagement with the keeper, said abutment surfaces extend in a plane of engagement that is not inclined by more than about five degrees relative to said base plane.

4. The cam and keeper of claim 1 wherein the first V-shaped notch and the first wedge-shaped cross section are configured such that, as they engage while the cam is being rotated about the central axis of the cam into latching engagement with the keeper, the engagement therebetween serves to bring the first and second center planes relatively toward each other.

5. The cam and keeper of claim 1 wherein the first arm extends for a longer distance from the central axis than does the second arm, the first V-shaped notch is longer than the second V-shaped notch, and, the opposed side surfaces of the first post formation that are engaged by opposed side surfaces of the first V-shaped notch are longer than are the opposed side surfaces of the second post formation that are engaged by the opposed side surfaces of the second V-shaped notch.

6. The cam and keeper of claim 5 wherein the opposed side surfaces of the first V-shaped notch are inclined relative to the first center plane at a first angle of inclination, the opposed side surfaces of the second V-shaped notch are inclined relative to the first center plane at a second angle of inclination, and the second angle of inclination is greater than is the first angle of inclination.

7. The cam and keeper of claim 6 wherein the first angle of inclination is approximately fifteen degrees, and the second angle of inclination is approximately twenty-five degrees.

8. The cam and keeper of claim 1 wherein wedge-shaped formations are defined by the keeper where opposite sides of the second post formation join with the base, the wedge-shaped formations define substantially flat front surface portions that are inclined with respect to the base plane and that join smoothly with the forward surface of the base near where the inner end formation of the second post formation joins with the forward surface, and the second arm of the cam defines rearwardly facing surface portions that abuttingly engage the flat front surface portions when the cam has been rotated about the central axis to the position of full latching engagement with the keeper.

9. The cam and keeper of claim 1 wherein the first arm of the cam has a first end region that is configured to engage the forward surface of the base of the keeper when the cam is rotated about the central axis in an unlatching direction that takes the cam out of full latching engagement with the keeper, with the engagement between the first end region and the forward surface causing the central axis about which the cam rotates to be moved away from the forward surface A) to assist in breaking open the door that has been latched closed by the cam and keeper, and B) to aid in positioning the U-shaped recess formation to drivingly engage and closely receive the inner end portion of the head formation therein and to wrap closely about the inner end portion of the head formation when the cam is rotated about said central axis out of latching engagement with the keeper.

10. The cam and keeper of claim 1 wherein the inner end formation of the first post formation is joined smoothly with the forward surface of the keeper base by a curved formation having a first radius of curvature, the inner end formation of the second post formation is joined smoothly with the forward surface of the keeper base by a curved formation having a second radius of curvature, and the first radius of curvature is greater than is the second radius of curvature.

11. The cam and keeper of claim 1 wherein the base is of generally rectangular shape, has opposed, relatively long side edges, has opposed, relatively short ends, and has a recess formed centrally along each of the side edges wherein welds for mounting the keeper can be formed when the rearward mounting surface is in engagement with a door frame portion on which the keeper is to be mounted.

12. The cam and keeper of claim 1 wherein the cam also has an elongate stem portion that projects from the body along the central axis for connection to a selected end region of an elongate lock rod of a door control mechanism.

13. The cam and keeper of claim 12 wherein the stem portion defines a circumferentially extending flange that defines a shoulder configured to face toward the lock rod for being engaged by a bearing cover of a bearing assembly that journals the lock rod for rotation about the central axis.

14. A door control mechanism that includes the cam and keeper of claim 1, wherein the door control mechanism has an elongate lock rod that is journaled by door mounted bearings for rotation about said central axis, and that has said cam connected to a selected end region of the lock rod for rotation with the lock rod about said central axis.

15. The door control mechanism of claim 14 wherein the cam defines a formation that is engaged by a bearing cover that is employed in mounting one of the bearings on the door.

16. The door control mechanism of claim 15 wherein the lock rod carries at least one elongate component that is rotatable with the lock rod about said central axis, which elongate component has opposed end surfaces at spaced locations along said central axis that are engaged by separate bearing covers that are employed in mounting two of said bearings on the door.

17. A cam and keeper combination for a door control mechanism used to latch a pivoted door closed, comprising a cam and keeper wherein the cam may be pivoted into and out of latching engagement with the keeper by operating the door control mechanism, and comprising:

a) the cam being a two-armed cam having a central body portion from which the two arms extend in generally opposite directions, with one of the arms being longer than the other, with each of the arms defining a generally V-shaped notch, and with the V-shaped notch formed in the longer arm being longer than the V-shaped notch formed in the shorter arm;

b) the keeper being a two-post keeper, with one the posts having relatively long opposed side surfaces configured to be engaged by opposed side surfaces of the longer V-shaped notch, with the other of the posts having relatively short opposed side surfaces configured to be engaged by opposed side surfaces of the shorter V-shaped notch, with the one and other posts being connected to an elongate base and being separated from each other by a space configured to receive the central body portion of the two-armed cam when the cam and keeper are in a position of full latching engagement wherein the first V-shaped notch has its opposed side surfaces in engagement with the opposed side surfaces of the one post, and the second V-shaped notch has its opposed side surfaces in engagement with the opposed side surfaces of the other post;

c) an enlarged head formation connected to the one post at a location therealong spaced from the base, with the head formation defining portions that overlie the base including an end formation that extends generally toward the other post so as to overlie at least a portion of said space, with said portions that overlie the base cooperating to define a generally flat abutment surface of the keeper that is engageable by a generally flat abutment surface defined by the one arm of the cam, with engagement of said abutment surfaces taking place when the cam is in a position of full latching engagement with the keeper;

d) with the cam having U-shaped recess formation means located near where the longer arm joins with the central body portion of the cam for closely receiving said end formation therein and for drivingly engaging said end formation so that the U-shaped recess is caused to wrap closely about said end formation to effect movement of the central body portion of the cam into and out of said space located between the two posts during latching and unlatching of the cam and the keeper.

18. The cam and keeper of claim 17 wherein the longer arm of the cam has an end region configured to engage a forward surface of the base during unlatching of the cam from the keeper A) for assisting in pivoting the closed door out of its closed position and b) for assisting in positioning the U-shaped recess formation means to closely receive and drivingly engage said end formation to wrap closely about said end formation during unlatching of the cam and keeper.

19. The cam and keeper of claim 17 wherein, when the cam is in the position of full latching engagement with the keeper, the engaged abutment surfaces extend in a plane of engagement that is not inclined by more than about five degrees relative to a plane in which the base extends.

20. The cam and keeper of claim 17 wherein the opposed side surfaces of the longer V-shaped notch and the opposed side surfaces of the shorter V-shaped notch extend substantially symmetrically about a first imaginary center plane that intersects both of the V-shaped notches, wherein the relatively long opposed side surfaces and the relatively short opposed side surfaces of the two posts extend substantially symmetrically about a second imaginary center plane that intersects both of the posts, and wherein the engagement that takes place between the side surfaces of the V-shaped notches and the side surfaces of the posts as the cam is being pivoted into latching engagement with the keeper provides a wedging action that serves to bring the first and second center planes relatively toward each other.

21. The cam and keeper of claim 20 wherein the opposed side surfaces of the longer V-shaped notch are inclined relative to the first center plane at a first angle of inclination, the opposed side surfaces of the shorter V-shaped notch are inclined relative to the first center plane at a second angle of inclination, and the second angle of inclination is greater than is the first angle of inclination.

22. The cam and keeper of claim 21 wherein the first angle of inclination is approximately fifteen degrees, and the second angle of inclination is approximately twenty-five degrees.

23. The cam and keeper of claim 17 wherein the cam also has an elongate stem portion that projects from the body portion along the central axis for connection to a selected end region of an elongate lock rod of the door control mechanism.

24. The cam and keeper of claim 23 wherein the stem portion defines a circumferentially extending flange that defines a shoulder configured to face toward the lock rod for being engaged by a bearing cover of a bearing assembly that journals the lock rod for rotation about the central axis.

25. A door control mechanism that includes the cam and keeper of claim 17, wherein the door control mechanism has an elongate lock rod that is journaled by door mounted bearings for rotation about said central axis, and that has said cam connected to a selected end region of the lock rod for rotation with the lock rod about said central axis.

26. The door control mechanism of claim 25 wherein the cam defines a formation that is engaged by a bearing cover that is employed in mounting one of the bearings on the door.

27. The door control mechanism of claim 25 wherein the lock rod carries at least one elongate component that is rotatable with the lock rod about said central axis, which elongate component has opposed end surfaces at spaced locations along said central axis that are engaged by separate bearing covers that are employed in mounting two of said bearings on the door.

28. A cam and keeper combination for a door control mechanism that is used to hold closed a relatively flat door in the presence of door loading forces that have a force component that extends substantially normal to the plane of the flat door, comprising a cam and a keeper wherein the cam is pivotally movable into and out of a position of full latching engagement with the keeper, and comprising:

a) the cam being an elongate cam and the keeper being an elongate keeper that cooperate to define two sets of matingly engageable wedge surfaces located on opposite sides of a space that is occupied by a central body portion of the cam when the cam and keeper are in full latching engagement with the two sets of wedge surfaces matingly engaged, with the cam being movable about a central axis that intersects the central body portion of the cam to latch and unlatch the cam and keeper;

b) abutment formation means for defining on the cam and on the keeper a pair of relatively flat abutment surfaces that engage when the cam and keeper are in full latching engagement, with engaging portions of the abutment surfaces being defined at least in part by a keeper formation on the keeper that overlies a portion of said space; and, c) U-shaped recess means defined by the cam and configured for drivingly engaging and for closely receiving said keeper formation therein and for wrapping closely about said keeper formation as the cam is pivoted into and out of latching engagement with the keeper to effect movement of the central body portion of the cam into and out of said space during latching and unlatching of the cam and the keeper.

29. The cam and keeper of claim 28 wherein the flat abutment surfaces are defined by the cam and keeper so as to engage and extend in a common plane when the cam and keeper are in full latching engagement, with said common plane not for being inclined relatively to the plane of the flat door by greater than about five degrees.

30. The cam and keeper of claim 28 wherein the sets of matingly engageable wedge surfaces are defined by a pair of opposed arm formations of the cam that each define a separate V-shaped notch, and by a pair of post formations of the keeper that each have a wedge-shaped cross-section configured to extend into a separate one of the V-shaped notches, and wherein the flat abutment surfaces are defined by a forward surface provided on one of the arm formations, and by a rearward surface provided on an enlarged head portion of one of the post formations.

31. The cam and keeper of claim 30 wherein said one of the arm formations is longer than the other in that said longer arm formation extends away from the central axis for a greater distance than does the other, wherein the V-shaped notch that is formed in the longer arm formation extends for a greater length than does the V-shaped notch that is formed in the other arm formation, wherein the post formation that is engaged by the the longer arm formation has opposed sides that are longer than opposed sides of the other of the post formations, wherein opposed sides of the post formation engaged by the longer V-shaped notch engage the longer opposed sides of the post formation engaged by the longer arm formation when the cam is in full latching engagement with the keeper, and wherein opposed sides of the other V-shaped notch engage the opposed sides of the other post formation when the cam is in full latching engagement with the keeper.

32. The cam and keeper of claim 31 wherein the longer arm formation has an end formation configured to engage a forward surface defined by the keeper during unlatching of the cam from the keeper A) for assisting in pivoting the closed door out of its closed position and B) for assisting in positioning the U-shaped recess means to drivingly engage and to closely receive therein the keeper formation and to wrap closely about the keeper formation during unlatching of the cam and the keeper.

33. The cam and keeper of claim 31 wherein the opposed side surfaces of the longer V-shaped notch are inclined relative to a first center plane at a first angle of inclination, the opposed side surfaces of the other V-shaped notch are inclined relative to the first center plane at a second angle of inclination, and the second angle of inclination is greater than is the first angle of inclination.

34. The cam and keeper of claim 33 wherein the first angle of inclination is approximately fifteen degrees, and the second angle of inclination is approximately twenty-five degrees.

35. The cam and keeper of claim 28 wherein the cam also has an elongate stem portion that projects from the central part along the central axis for connection to a selected end region of an elongate lock rod of the door control mechanism.

36. A door control mechanism that includes the cam and keeper of claim 28, wherein the door control mechanism has an elongate lock rod that is journaled by door mounted bearings for rotation about said central axis, and that has said cam connected to a selected end region of the lock rod for rotation with the lock rod about said central axis.

37. The door control mechanism of claim 36 wherein the cam defines a formation that is engaged by a bearing cover that is employed in mounting one of the bearings on the door.

38. The door control mechanism of claim 36 wherein the lock rod carries at least one elongate component that is rotatable with the lock rod about said central axis, which elongate component has opposed end surfaces at spaced locations along said central axis that are engaged by separate bearing covers that are employed in mounting two of said bearings on the door.

39. A door control mechanism for securing a door, swingable about a generally vertical axis, in closed position closing a door opening bordered at its top and bottom by top and bottom portions of a frame, wherein the door control mechanism is of the type comprising:

a) an elongate tubular lock rod formed from steel tubing and defining upper and lower end regions near opposite ends thereof;

b) a tubular steel sleeve encircling and being secured to the tubular lock rod at a location between the upper end region and the lower end region, and defining an upwardly facing sleeve engagement surface and a downwardly facing sleeve engagement surface located near opposite ends of the sleeve;

c) an upper cam type latch member secured to the upper end region of the lock rod and defining a downwardly facing latch member engagement surface;

d) a lower cam type latch member secured to the lower end region of the lock rod and defining an upwardly facing latch member engagement surface;

e) an upper keeper member adapted to be affixed to the top portions of the frame at a location that is adjacent the upper cam type latch member when the door is closed for receiving the upper cam type latch member to secure the door closed;

f) a lower keeper member adapted to be affixed to the bottom portions of the frame at a location that is adjacent the lower cam type latch member when the door is closed for receiving the lower cam type latch member to secure the door closed;

g) bearing means including a plurality of spaced bearing members that receive portions of the lock rod for mounting the lock rod on the door to extend the height of the door, and for journaling the lock rod for pivotal movement about an imaginary central axis that extends longitudinally with respect to the lock rod and that is oriented to extend generally vertically when the bearing means mount the lock rod to extend the height of the door, with each of the spaced bearing members having a separate steel bearing cover that defines an associated upwardly facing contact surface and an associated downwardly facing contact surface;

h) means for pivoting the lock rod about the imaginary central axis;

i) with the lock rod being prevented from moving axially along the imaginary central axis relative to the door by locating the steel bearing covers such that each of the two downwardly facing engagement surfaces is engaged by a different one of the upwardly facing contact surfaces, and such that each of the two upwardly facing engagement surfaces is engaged by a different one of the downwardly facing contact surfaces; and, j) wherein at least a chosen one of the upper cam member and lower cam member and its associated keeper cooperate to define:

A) two sets of matingly engageable wedge surfaces located on opposite sides of a space that is sided by a central body portion of the at least one cam member when the at least one cam member and its associated keeper are in full latching engagement with their two sets of wedge surfaces matingly engaged;

B) two flat upper abutment surfaces that engage when the at least one cam member and its associated keeper are in full latching engagement, with engaging portions of the abutment surfaces being defined in part by a keeper formation of said associated keeper that overlies a portion of said space; and, C) U-shaped recess means defined by the at least one cam member and configured for drivingly engaging and for closely receiving said keeper formation therein for closely wrapping the U-shaped recess means about said keeper formation as the at least one cam member is pivoted into and out of latching engagement with its associated keeper to effect positive movement of the central body portion of the cam into and out of said space during latching and unlatching engagement of the at least one cam member with its associated keeper.

40. The door control mechanism of claim 39 wherein an adjacent pair of the steel bearing covers sandwiches the sleeve such that each cover of the pair of covers has one of its contact surfaces engaging a separate one of the sleeve engagement surfaces, with a selected one of the pair of covers having its other contact surface engaging a selected one of the two latch member engagement surfaces.

41. The door control mechanism of claim 40 wherein still another one of the steel bearing covers has one of its contact surfaces engaging the other of the two latch member engagement surfaces.

42. The door control mechanism of claim 39 wherein a selected one of the upper and lower cam members and the sleeve sandwich a selected one of the steel bearing covers in a manner that causes the contact surfaces of the selected bearing cover to each be engaged by a different one of the engagement surfaces that are defined by the selected cam member and by the sleeve.

43. The door control mechanism of claim 42 wherein still another of the steel bearing covers has one of its contact surfaces engaging the other engagement surface of the sleeve.

44. The door control mechanism of claim 39 wherein the tubular lock rod is formed from a single continuous length of steel tubing.

45. The door control mechanism of claim 39 wherein the tubular lock rod is formed by two lengths of steel tubing arranged end-to-end to form a juncture therebetween, and the tubular sleeve bridges the juncture and is connected by a welding process to each of the two lengths of tubing.

46. The door control mechanism of claim 39 wherein the upper and lower cam members and the tubular sleeve all are connected to the lock rod by a welding process; the welding process is carried out at a time after the lock rod has been protectively coated to provide corrosion resistance; the welding process causes welds to be formed that burn through the protective coatings; and the welds are protectively coated to provide corrosion resistance by a dried film of zinc and clear organic coating.

47. The door control mechanism of claim 39 wherein the steel sleeve has a generally cylindrical side wall through which an opening is formed, and at least one weld is provided within the confines of said opening to connect the sleeve to the lock rod.

48. The door control mechanism of claim 39 wherein a selected one of the bearing members includes a plastic bearing liner that is at least partially enclosed by the steel bearing cover of the selected bearing member, with aligned holes being formed through the the bearing cover and the plastic bearing liner to receive threaded fasteners that mount the selected bearing member on the door but can be removed to permit the plastic bearing liner to be serviced or replaced, as needed.

49. The door control mechanism of claim 39 wherein a selected one of the bearing members includes a plastic bearing liner carried, at least in part, in an enlarged centrally located formation of the steel bearing cover of the selected bearing member.

50. The door control mechanism of claim 49 wherein the plastic bearing liner includes a backing member that extends between a back surface of the lock rod and the door, and a U-shaped member that has opposed legs that extend along opposite sides of the lock rod and are connected by a C-shaped formation that wraps about a front surface of the lock rod, with the C-shaped formation and the backing member cooperating to define arcuate, lock-rod-engaging surfaces that extend into engagement with the front and back surfaces of the lock rod to assist in journaling the lock rod for pivotal movement about said central axis.

* * * * *